US009526317B2

(12) United States Patent
Willows et al.

(10) Patent No.: US 9,526,317 B2
(45) Date of Patent: Dec. 27, 2016

(54) BOTTLE WITH MATING CLIP

(71) Applicant: Amphipod, Inc., Seattle, WA (US)

(72) Inventors: Keith S. Willows, Seattle, WA (US); June A. Angus, Seattle, WA (US); Antonio Del Rosario, Bellevue, WA (US)

(73) Assignee: AMPHIPOD, INC., Seattle, WA (US)

( * ) Notice: Subject to any disclaimer, the term of this patent is extended or adjusted under 35 U.S.C. 154(b) by 286 days.

(21) Appl. No.: 14/222,976

(22) Filed: Mar. 24, 2014

(65) Prior Publication Data

US 2014/0202982 A1 Jul. 24, 2014

Related U.S. Application Data

(63) Continuation-in-part of application No. 14/175,912, filed on Feb. 7, 2014, now Pat. No. 9,320,342, and a continuation of application No. 13/409,469, filed on Mar. 1, 2012, now Pat. No. 8,727,153, and a continuation of application No. 12/945,604, filed on Nov. 12, 2010, now Pat. No. 8,152,011, and a continuation of application No. 11/117,261, filed on Apr. 27, 2005, now Pat. No. 7,845,506.

(51) Int. Cl.

| | |
|---|---|
| ***A45F 3/16*** | (2006.01) |
| ***B65D 1/02*** | (2006.01) |
| ***A45F 5/02*** | (2006.01) |
| ***B65D 23/00*** | (2006.01) |

(52) U.S. Cl.

CPC ..... *A45F 3/16* (2013.01); *A45F 5/021* (2013.01); *B65D 1/0223* (2013.01); *B65D 23/003* (2013.01); *A45F 2200/0583* (2013.01); *B65D 2501/0081* (2013.01)

(58) Field of Classification Search

CPC .... A45F 3/16; A45F 5/021; A45F 2200/0583; B65D 1/0223; B65D 23/003; B65D 2501/0081

See application file for complete search history.

(56) References Cited

U.S. PATENT DOCUMENTS

| | | | | | |
|---|---|---|---|---|---|
| D95,900 | S | * | 6/1935 | Dunnock | D9/550 |
| D99,819 | S | * | 5/1936 | McLaughlin | D9/563 |
| D108,796 | S | * | 3/1938 | Petty | D9/570 |
| 3,212,660 | A | | 10/1965 | Adell | |
| 3,533,526 | A | | 10/1970 | Adell | |
| 3,537,498 | A | | 11/1970 | Amand | |
| 3,964,709 | A | | 6/1976 | LaBelle et al. | |
| 3,981,166 | A | | 9/1976 | Madonna | |
| 4,121,797 | A | | 10/1978 | MacNeil | |
| 4,150,806 | A | | 4/1979 | Dziuk | |
| 4,270,231 | A | | 6/1981 | Zint | |
| 4,366,922 | A | | 1/1983 | Levine et al. | |
| D285,659 | S | | 9/1986 | Paulovich et al. | |

(Continued)

*Primary Examiner* — Tri Mai

(74) *Attorney, Agent, or Firm* — Lowe Graham Jones PLLC

(57) ABSTRACT

An improved bottle having a mating clip is disclosed. The bottle includes a guide, preferably located on opposing sidewalls of the bottle, to direct attachment features of a clip toward mating attachment features of a bottle in order to facilitate attachment of the bottle to the clip in a tactile fashion. The guide further serves as a release mechanism, in which an inward force applied to the guide will cause deflection of the bottle to separate the clip from the bottle.

22 Claims, 27 Drawing Sheets

(56) References Cited

U.S. PATENT DOCUMENTS

| | | | | | |
|---|---|---|---|---|---|
| 4,723,801 | A | | 2/1988 | Musumeci et al. | |
| 4,733,836 | A | | 3/1988 | Barnes | |
| 5,042,770 | A | | 8/1991 | Louthan | |
| D322,212 | S | * | 12/1991 | Bourassa | D9/563 |
| 5,105,958 | A | | 4/1992 | Patton | |
| 5,115,952 | A | | 5/1992 | Jenkins | |
| 5,123,554 | A | | 6/1992 | Arvidson et al. | |
| 5,170,658 | A | | 12/1992 | Thayer | |
| 5,224,614 | A | | 7/1993 | Bono et al. | |
| 5,299,700 | A | * | 4/1994 | Beniacar | B65D 23/0857 206/485 |
| 5,326,006 | A | | 7/1994 | Giard, Jr. | |
| RE34,725 | E | | 9/1994 | Braden | |
| 5,366,102 | A | * | 11/1994 | Bergner | B65D 23/0857 206/459.5 |
| 5,549,074 | A | * | 8/1996 | Hui | A01K 1/0356 119/464 |
| 5,624,064 | A | | 4/1997 | McGee, Jr. | |
| 5,669,329 | A | | 9/1997 | Krause | |
| 6,003,703 | A | * | 12/1999 | Ruggeri | B65D 25/22 215/396 |
| D423,774 | S | | 5/2000 | Peterson | |
| 6,401,997 | B1 | | 6/2002 | Smerdon, Jr. | |
| 6,598,837 | B1 | | 7/2003 | Howard et al. | |
| 6,752,284 | B1 | | 6/2004 | Akiyama et al. | |
| D494,471 | S | | 8/2004 | Chou | |
| 6,808,149 | B1 | | 10/2004 | Sendowski et al. | |
| D498,357 | S | | 11/2004 | Smith | |
| 6,837,472 | B1 | | 1/2005 | Beutz | |
| D502,366 | S | | 3/2005 | Strepkoff | |
| 7,845,506 | B2 | | 12/2010 | Willows et al. | |
| 8,069,986 | B2 | * | 12/2011 | Darr | B65D 1/0276 206/509 |
| 8,071,933 | B2 | * | 12/2011 | Ophardt | A47K 5/1217 222/181.1 |
| 8,727,153 | B2 | | 5/2014 | Willows et al. | |

* cited by examiner

BOTTLE WITH MATING CLIP

PRIORITY CLAIM

This application is a continuation-in-part of U.S. application Ser. No. 14/175,912 filed Feb. 7, 2014, which is a continuation of U.S. application Ser. No. 13/409,469 filed Mar. 1, 2012, which is a continuation of U.S. patent application Ser. No. 12/945,604 filed Nov. 12, 2010, which is a continuation of U.S. patent application Ser. No. 11/117,261 filed Apr. 27, 2005, which claims the benefit under 35 U.S.C. §119(e) of U.S. Provisional Application Ser. No. 60/566,378, filed Apr. 28, 2004 and U.S. Provisional Application Ser. No. 60/579,054 filed Jun. 10, 2004, the contents of each of which is hereby incorporated by reference.

FIELD OF THE INVENTION

The present invention relates to a clip and mating bottle wherein the clip is manufactured such that it performs the function of firmly and reliably holding a bottle or similar item to be carried and provides simple ready-access to the bottle while a user is running, walking, exercising, etc. The clip is preferably formed in a shape in which it can be removably fastened to a belt, strap or the like.

BACKGROUND OF THE INVENTION

Sport, travel and general merchandise stores commonly sell articles for holding water and hydrating fluids for use during a variety of activities to enable the user to keep one's body healthfully hydrated, ward off thirst and improve sports performance. These fluid carrying articles are used for, and during, activities from leisurely walking and everyday use to hiking and more endurance sports or activities such as running, in-line skating, triathlons and adventure racing. These articles, depending on their configuration, provide varying levels of comfort and convenience relative to the intended activity and unique/varying activity variables.

Originally, day hikers used small to large, frame-less and internal/external frame, backpacks with shoulder straps, to carry bottles of water or other containers for holding fluids in a hands-free fashion. With the increased popularity of running and fitness, waist water carriers with fabric/foam-type holsters have become popular with the need for people to carry primarily just water and basic minimal essentials. There are many variations of belts and waist packs made for carrying fluid containers readily available as well as bladder-style packs and belts. Also there are add on fabric/foam style holsters which slide on a belt with a belt loop so you can add fluid containers to an existing belt. Additionally, hand carrying a water bottle with a hand strap or just by itself is also a popular alternative to a waist pack for some people.

Although there are many solutions for carrying hydrating fluids, they suffer from drawbacks of one sort or another. Waist bottle packs with fabric, elastic and/or foam holsters in some cases have the bottle holster fixed/sewn on the belt so that the user has little ability to customize the belt and bottle position for their own particular needs. Usually the only adjustments are sizing of the belt and in order to adjust the position of the bottle or bottles on the belt the user has to rotate the whole belt around on the waist which can be a problem if a buckle or some other feature of the belt/pack ends up in an uncomfortable or unfavorable position on the user. For a bottle pack with more than one holster, moving holster positions relative to each other around the belt so that the bottle position is specific to the fit/use requirements of the user is not possible because these holsters are generally sewn in place on the waist belt. Also the fabric, foam, elastic, etc associated with creating the holster itself and integrating it into the belt/pack in a way that is comfortable for the wearer in highly active conditions can be a source of significant unwanted weight.

Add-on holsters are usually made of the same or similar material (fabric, foam, elastic, etc.) as the above mentioned bottle pack holsters in a similar manner although a belt loop or loops are provided for threading the holster onto a separate belt. As with the above mentioned bottle pack holsters the fabric, foam, elastic, etc associated with creating the holster and belt loop panel can be a source of significant unwanted weight. Also the add-on holsters generally do not integrate well with a belt itself and tend to slide, bounce and chafe.

Although bladder packs have become smaller in size than those initially available, they are still not optimal, especially for running and sports which cause the user's body to undergo jostling or up and down movement due to discomfort associated with the size of the pack, larger sweat trapping area, chafing of shoulder/waist straps, and the inconvenience for such sports as running to drink/draw water from the tube and difficulty with filling and keeping the bladder and tubing hygienic. Some bladder/built-in reservoir packs have eliminated the drinking tube altogether, but are not practical for accessing the contained fluids on-the-go because the whole belt has to be removed/unbuckled to drink from them.

Many active people completely forgo using one of the above mentioned carriers in favor of hand carrying fluid in a bottle with or without a hand strap. But, hand carrying water can be tiring on the hand and back, and cause hand cramping and generally may hinder competitive performance levels over longer periods of strenuous activity.

In addition, the above fluid carrying methods/products heretofore known, suffer from drawbacks and disadvantages in combinations in the following areas: cause user discomfort through bouncing and chafing; lack optimal ergonomics and contouring relative to the human body; incorporate complex use requirements or components; difficulty in accessing and replacement of bottle/container while in use; unreliable retainment or security of bottle in holster (falls out); require additional mechanism or extra user step to secure bottle fully in holster; limited bottle security for a wide range of conditions; lack optimum physics of carrying mass/fluid on the human body; employ features which present obstacles to optimal athletic or general performance; limited versatility for range of uses and range of users; difficult to use and/or inconvenient to use; difficult to clean and maintain hygienically; poorly integrated features; and asymmetrically weighted when in use.

SUMMARY OF THE INVENTION

This invention relates a clip and mating bottle, including a process for making them, to provide ready-access to fluids or the like wherein ready-access is desired while engaging in sports like running, biking, and many outdoor activities or the like. The disclosed invention offers a desirable solution for addressing this need in a comfortable, convenient and ergonomic and readily manufacturable manner.

The preferred clip is manufactured from plastic or other injection moldable material, although in other versions it may be formed in a different manner and using different materials. There are a number of plastics that can be formulated to injection mold the clip, including Acetyl, nylon, Ultem, and others.

The preferred bottle is manufactured by blow-molding using polypropylene or polyethylene (low to high density) or other materials, although in other versions it may be formed in a different manner and using different materials.

The illustrated version preferably comprises a user-removable pad, though in some versions the pad is eliminated, with corresponding through-holes filled or removed, such that the clip does not have a pad. Alternatively, flocking or the like could be added to the back side of the clip.

A strap/belt/pack can be configured to fit with the clip such that most of the back side of the clip is covered by the belt and in some cases the pad may not be needed and thus can be removed.

As configured in the preferred embodiment, the clip forms a lightweight, highly ergonomic, intuitive, comfortable, easy-to-use and reliable carrying system for a bottle or other similar item that allows simple, easy access to the bottle or the like while jogging, running or other physically demanding or other activities where ready-access to fluids or the like are desired.

These and other examples of the invention will be described in further detail below.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

More detailed references will now be made to the drawings in which the various elements of the present invention will be given numeral designations and in which the invention will be described so as to enable one skilled in the art to make and use the invention. It is to be understood that the following description is only exemplary of the principles of the invention, and should not be viewed as narrowing the scope of the invention.

Figure 1:
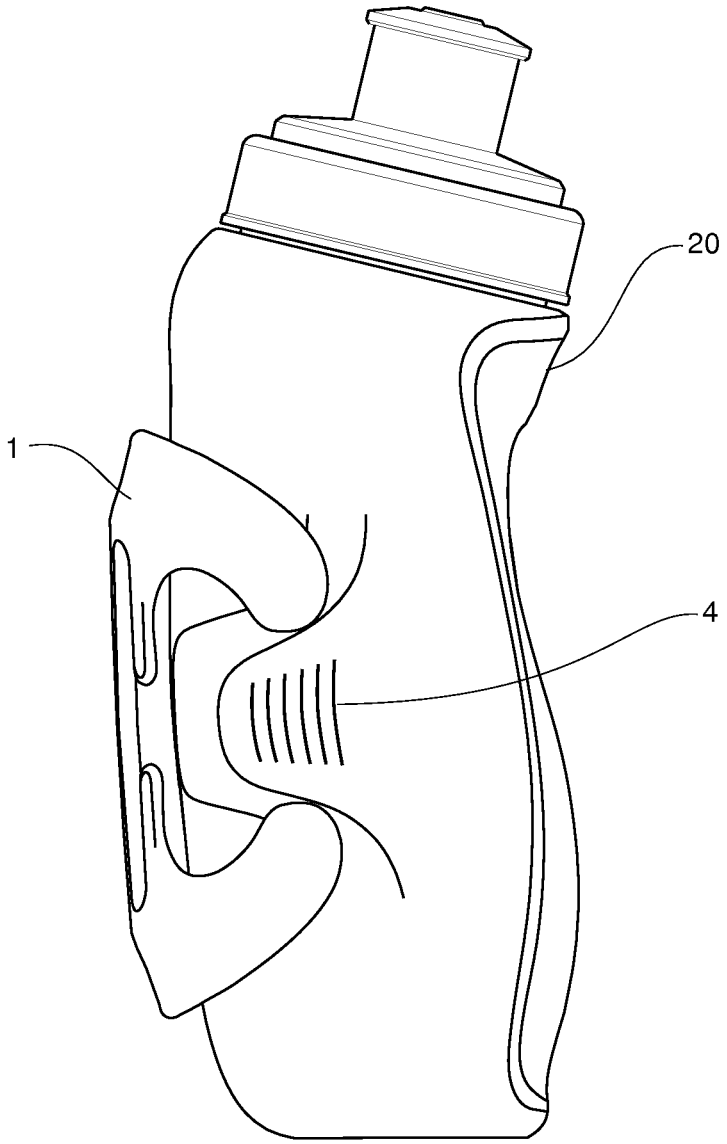
FIG. 1 is a side view of a preferred embodiment of the invention, having a clip 1, bottle 20 and optional grip detail feature 4.

FIG. 1 is a side view of a preferred embodiment of the invention. A clip 1, bottle 20, and optional grip detail feature 4 are shown. FIG. 1 illustrates the manner in which a bottle 20 is can be held within a clip 1 such that it functions to hold the bottle in place. An optional belt or strap is not shown, but in a preferred configuration it would be attached to the clip before the bottle is snapped in place, threading the strap (or belt or similar structure) through slots for retaining the clip on the belt. Examples of some threading methods are shown in U.S. Pat. No. 8,152,011 B2 (see, for example, FIGS. 16-21).

To release the bottle from the preferable clip a user would apply a force to the grip details 4. The force directed against the grip details urges the surrounding portion of the bottle sidewall inward, toward the interior of the bottle, and the deflection of the bottle serves to separate it from the clip.

The grip detail is preferably in the form of raised or lowered frictional surface details, positioned on opposite sides of the bottle to add desired friction and improve a user's grip of the bottle. Some versions of the bottle may not include such a frictional grip detail, such as illustrated as grip areas 21 and 22 in FIGS. 7 and 8.

Figure 2:
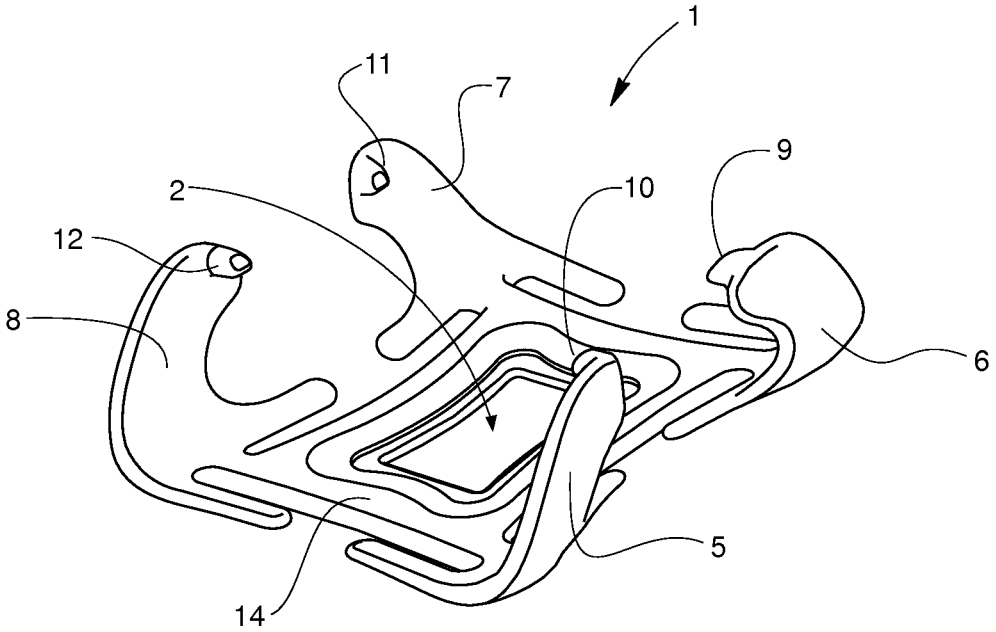
FIG. 2 is a perspective view of a clip 1 having a pad-mounting through-hole 2.
Figure 16:
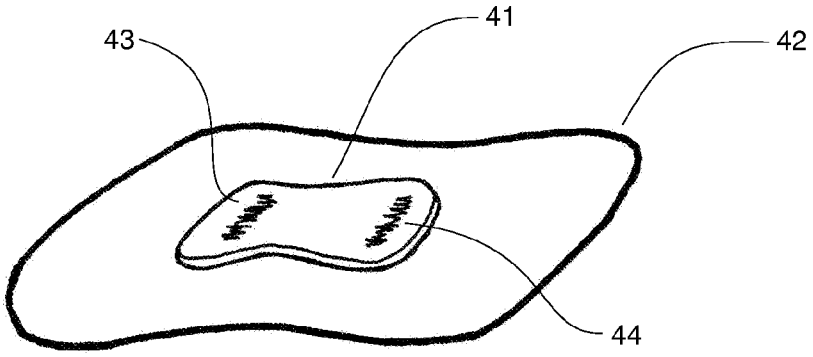
FIG. 16 a perspective view of a preferred assembled pad.
Figure 17:
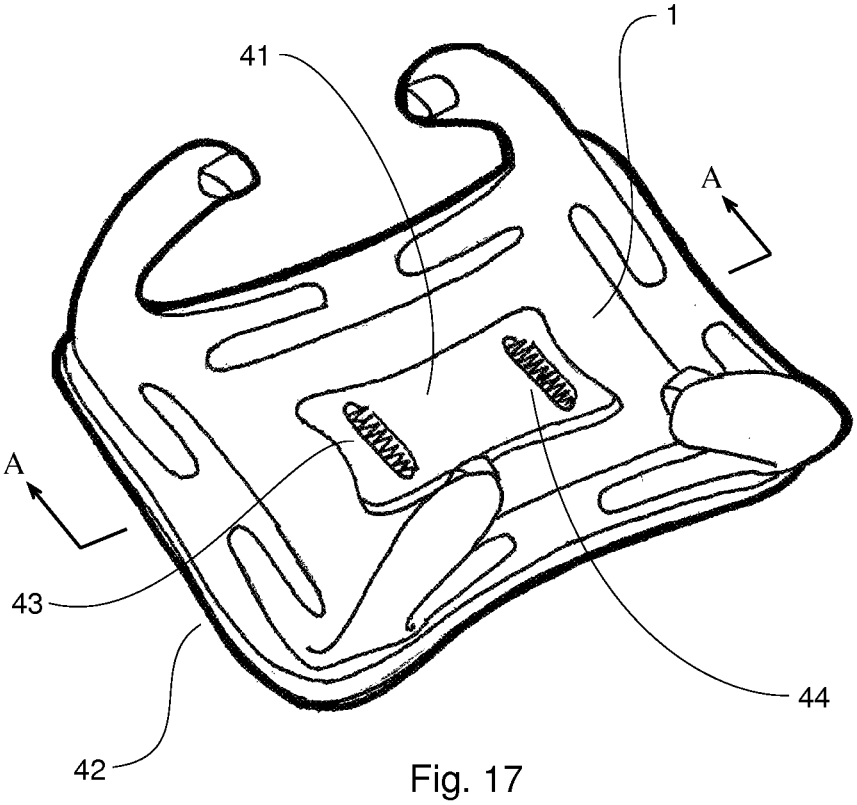
FIG. 17 is a perspective view of a preferred clip wherein a pad is assembled such that it is held in place trapped in through-hole 2 labeled in FIG. 2. Section cutting plane A-A is shown and is referenced in other figures.

FIG. 2 is a perspective view of a clip 1, and in the version illustrated in FIG. 2 it includes a pad-mounting through-hole 2. The pad-mounting through-hole is formed in a base 14 of the clip 1, providing a cut-out location in which a pad (as can be seen in FIGS. 16 and 17) may be installed if desired.

The illustrated clip 1 preferably has four arms 5, 6, 7, 8 extending upward from the base, each arm having a preferred protrusion 9, 10, 11, 12 located on the distal end of each arm. In the version as shown, the protrusions are each directed inward and toward an opposing arm and protrusion, such that the protrusions are configured to engage with receiving features on a bottle (such as receiving features 23, 24, 25, 26 in FIGS. 7 and 8). In one version, the receiving features are formed as distinct recesses in the bottle surface configured with sidewalls fully surrounding an interior space such that they snugly receive the clip protrusions. In other versions, the receiving features can take other forms, such as ridges, lips, troughs that function to engage the protrusions on the clip so that the bottle is held removably captive in the clip. Likewise, in some versions the clip may include divots or wells to receive projections formed on the bottle, in a reverse orientation from that shown in the illustrations.

Figure 3:
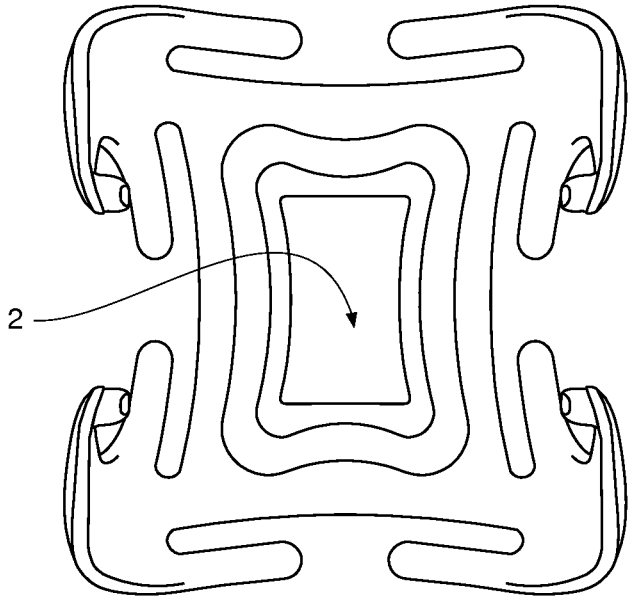
FIG. 3 is a front view of the clip shown in perspective in FIG. 2.

FIG. 3 is a front view of the clip shown in perspective in FIG. 2, such that the opposing protrusions can be seen extending inward toward one another. The through-hole 2 at the middle of the base is also illustrated.

Figure 4:
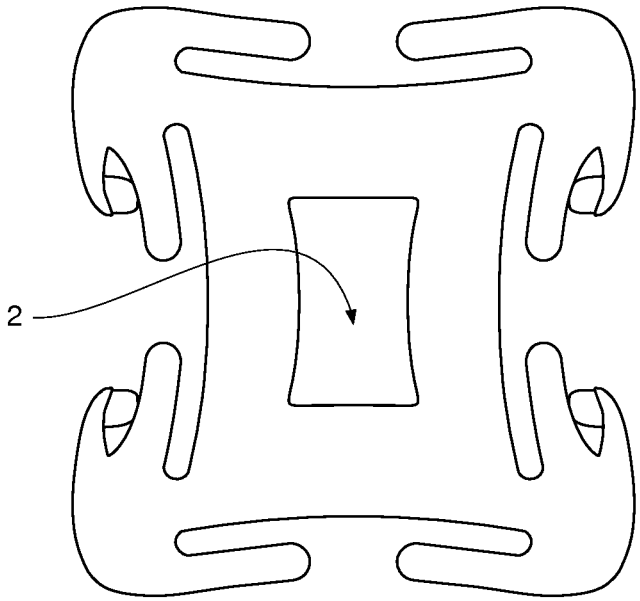
FIG. 4 is a back view of the preferable clip shown in perspective in FIG. 2. Preferable pad-mounting through-hole 2 is also labeled.

FIG. 4 is a back view of the clip shown in perspective in FIG. 2. A preferred pad-mounting through-hole 2 is also labeled wherein a pad may be assembled. In one example, a pad may be attached such that it is held captive but remains removably attached while covering the back side of the clip 1.

Figure 5:
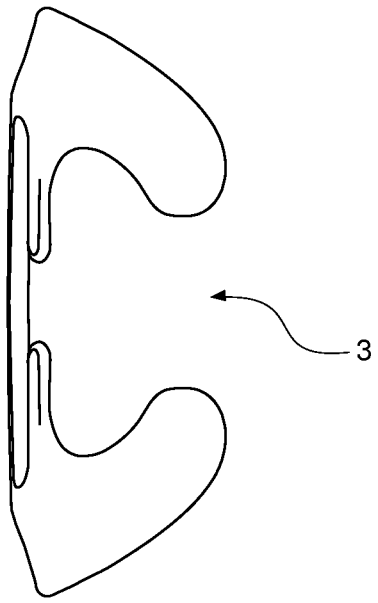
FIG. 5 is a left side view of the clip shown in perspective in FIG. 2, showing a preferred finger opening 3. Preferably the right side view is a mirror image of FIG. 5.

FIG. 5 is a left side view of the clip shown in perspective in FIG. 2. A preferred finger opening 3 is also indicated as the space between a pair of adjacent arms. Preferably the right side view is a mirror image of the view shown in FIG. 5. The finger opening 3 is preferably spaced such that a user's thumb and/or forefinger can be placed in the opening to allow access to depress bottle release features 21 and 22 (see FIGS. 7 and 8).

Figure 6:
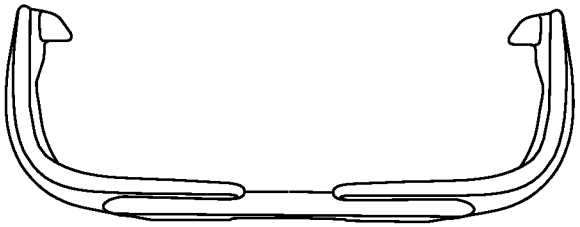
FIG. 6 is a bottom view of the clip shown in perspective in FIG. 2. Preferably, the top view is a mirror image.

FIG. 6 is a bottom view of the clip shown in perspective in FIG. 2. Preferably, the top view is a mirror image.

Figure 7:
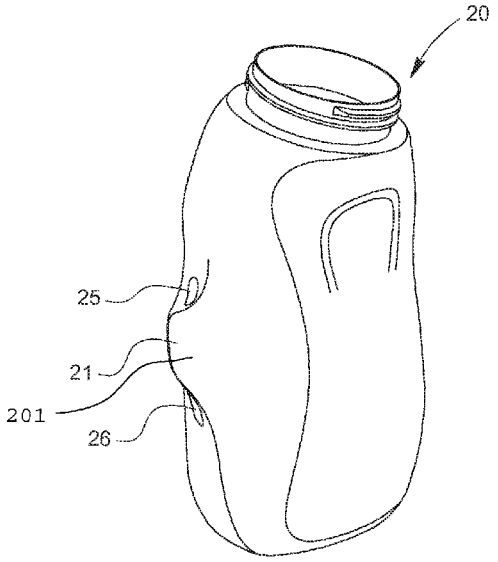
FIG. 7 is a perspective front view of preferred bottle 20, illustrated without a cap attached to the bottle.

FIG. 7 is a perspective front view of preferred bottle 20 for use together with a clip as described above. The bottle may include a cap, such as illustrated in FIG. 1, but which is not shown in FIG. 7.

Figure 8:
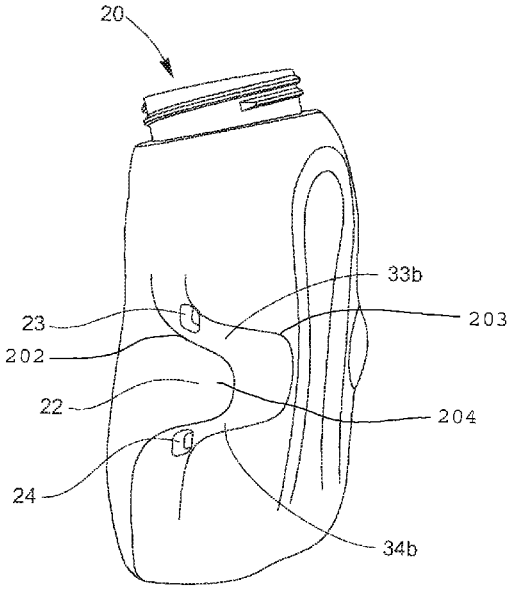
FIG. 8 is a perspective rear view of the bottle 20.

FIG. 8 is a perspective rear view of the bottle 20 of FIG. 7. As illustrated in FIGS. 7 and 8, the bottle comprises a pair of opposing convex bottle release features, or guides, 21 and 22, each being formed to serve to direct the clip toward the clip mounts (23, 24, 25, 26). The geometry of the preferred guides is described in greater detail with reference to FIG. 11.

Each guide is formed such that they extend laterally outwardly from the otherwise upwardly extending sidewalls of the bottle. The guides create a relatively rigid local area, requiring the application of an inwardly-directed force in order to collapse them. When a force is applied against the guides, it deflects the bottle sides 31 and 32 (see FIG. 10) inwardly, thus releasing clip protrusions 9, 10, 11, 12 from the receiving features 23, 24, 25, 26, (preferably formed as concavities such as wells or divots) thereby releasing the bottle from the clip.

The finger opening 3 as described above allows access to the guides 21 and 22 through the clip. The geometry of the clip and bottle allow a user to easily remove the bottle from the clip with a relatively small force, yet the bottle is held very securely in the clip in a manner that makes it easy to remove the bottle with the application of a force directed on the guides, but difficult for the bottle to be dislodged or come out unintentionally.

Figure 9:
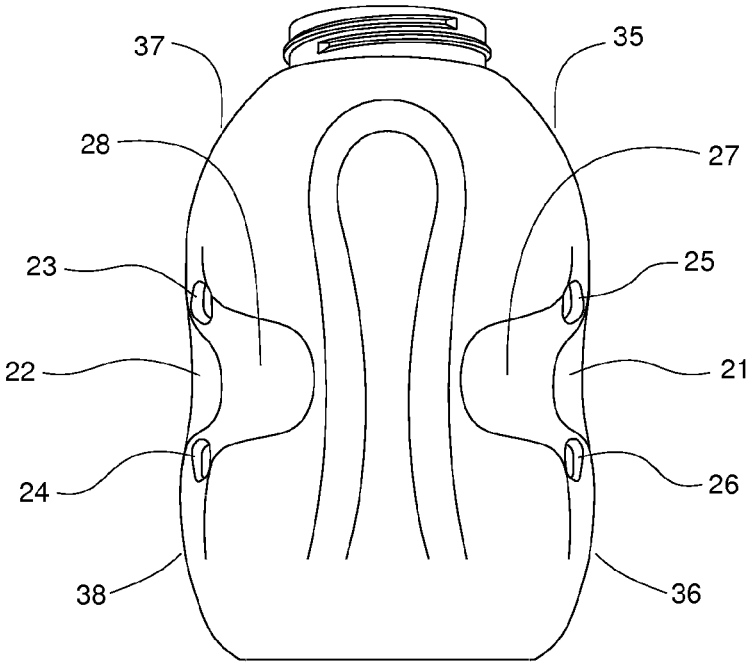
FIG. 9 is a rear view of the bottle 20.

FIG. 9 is a rear view of a preferred bottle 20 further illustrating the nature of the geometry of the guides 21, 22. At a rear-facing sidewall of the bottle (that is, the sidewall visible in the rear view of FIG. 9), the guides include rear convex protrusions or abutments 27 and 28 forming lateral sidewalls surrounding the guides, and which lead to the wells 23, 24, 25, 26. The convex abutments provide a structural stiffening to the area around bottle release guides 21 and 22 such that this local area does not collapse, thereby hampering inadvertent release of the bottle. The convex shape of the guides, which include lateral sidewalls around the guides 27 and 28 along a path from the rear of the guides to the wells 23, 24, 25, 26, provides a desirable locating feature to direct the protrusions into the wells.

Figure 11:
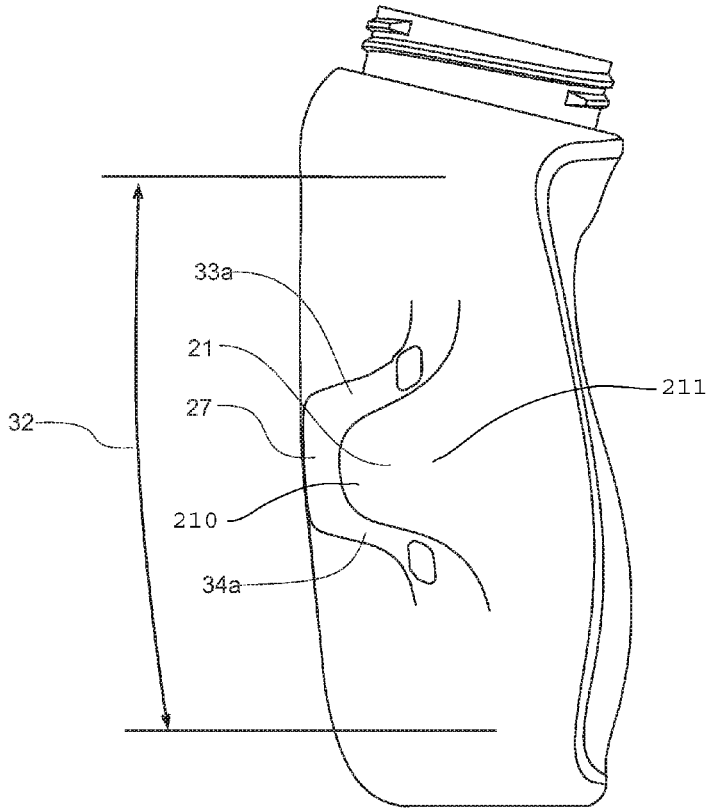
FIG. 11 is a left side view of the bottle 20. Preferably the right side is a mirror image.

The lateral guide sidewalls are also illustrated in the side view of FIG. 11, showing a first guide 21 having a narrow first end 210 at the rear side of the bottle (visible on the left side of the page in FIG. 11) and which flares to a vertically wider second end 211 at the front side of the bottle. The top, bottom, and rear portions of the guide are surrounded by lateral sidewalls 33*a*, 34*a*. This configuration produces a flared U-shape which is projected laterally outwardly, in a convex fashion, from the bottle sidewalls.

Figure 14:
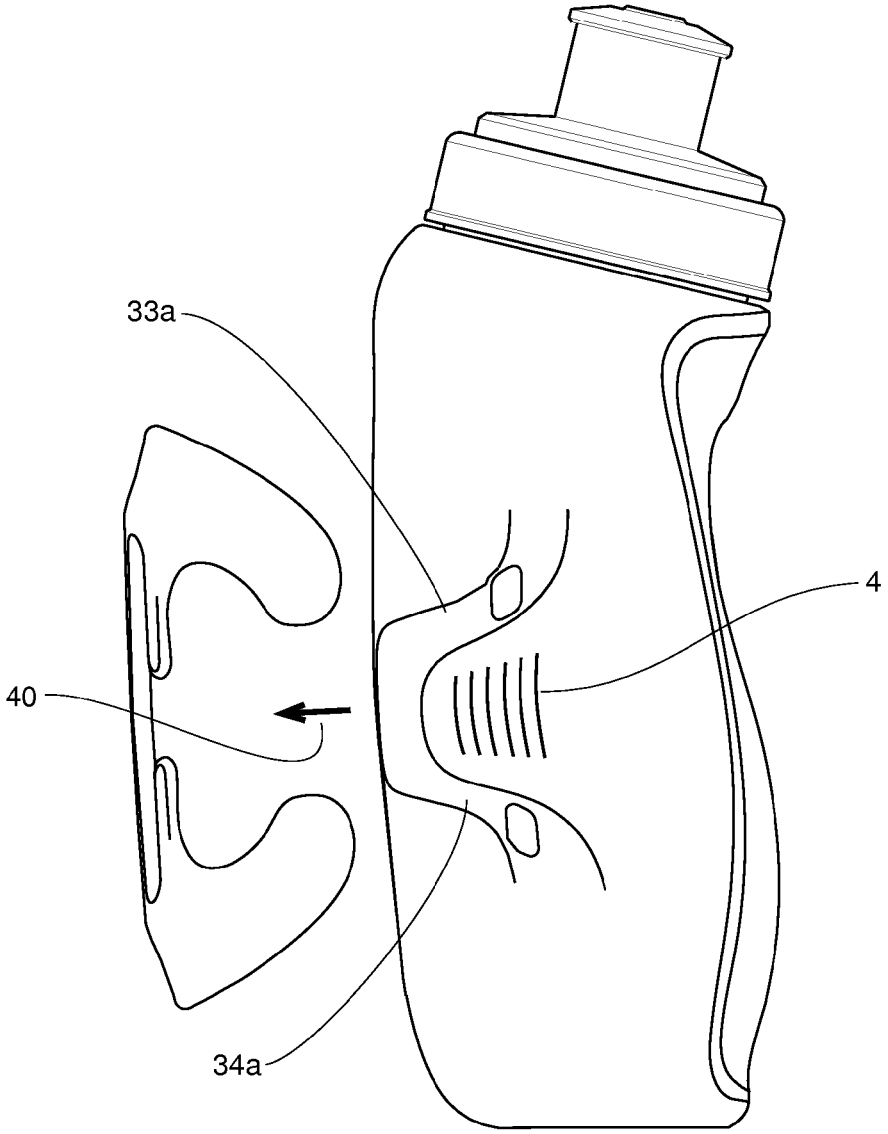
FIG. 14 is a side view of a preferred embodiment having a clip and a bottle.

The lateral sidewalls 33*a*, 34*a* of the flared U-shape forming the guide serve as lead-in surfaces to direct the projections toward the wells, as illustrated in FIG. 14, allowing the guides to nest within the finger openings 3. The lead-in surfaces allow a user to easily insert the bottle into the clip without looking, simply by directing the base of the U-shaped portion of the guide into the opening between the projections 9, 10, 11, 12, then allowing the lead-in surfaces to direct the projections into the wells. Although only one side is shown in FIG. 14, the opposite side is preferably configured as a mirror image and functions in the same manner.

The orientation of the lead-in surfaces preferably forms a skirt surrounding the guide to direct the clip to the wells. With reference to FIG. 8, the skirt is bounded by a first boundary line 202 and a second boundary line 203, so that the skirt forms an inclined surface between the first and second boundary lines. An outer face 204 of the guide 22 is in the interior bounded by the second boundary line, illustrated as being a vertical outer face, and with reference to FIG. 7 an outer face 201 is similarly indicated. The first boundary line 202 forms a juncture between the outer face and the lateral sidewall 33*b* shaped as an inclined skirt. Though the geometry may vary in different versions, the lead-in surfaces surrounding the guide are oriented to provide a surface extending along a direction that is angled toward the horizontal with respect to the orientation of the sidewall immediately adjacent the lead-in surfaces. Likewise, the lead-in surfaces are configured define a surface which is non-parallel to an axis extending vertically between the base and the opening of the bottle. In some cases, the lead-in surface (or lateral sidewalls 33*a*, 34*a* of the guide) may be fully horizontal with respect to a generally vertically-extending bottle sidewall. In most cases, however, the lead-in surfaces need only be inclined at an angle with respect to the surrounding sidewall, thereby defining a change in geometry that will direct the clip as described.

In a preferred version, the clip is formed with the protrusions arranged in a symmetrical fashion such that the bottle can fasten in the clip right-side-up or the user can flip the bottle upside-down and fasten the bottle in this position as well, the clip and bottle being configured to fasten to each other in both ways. And further the clip can fasten to a belt or strap in many ways as discussed above.

Figure 10:
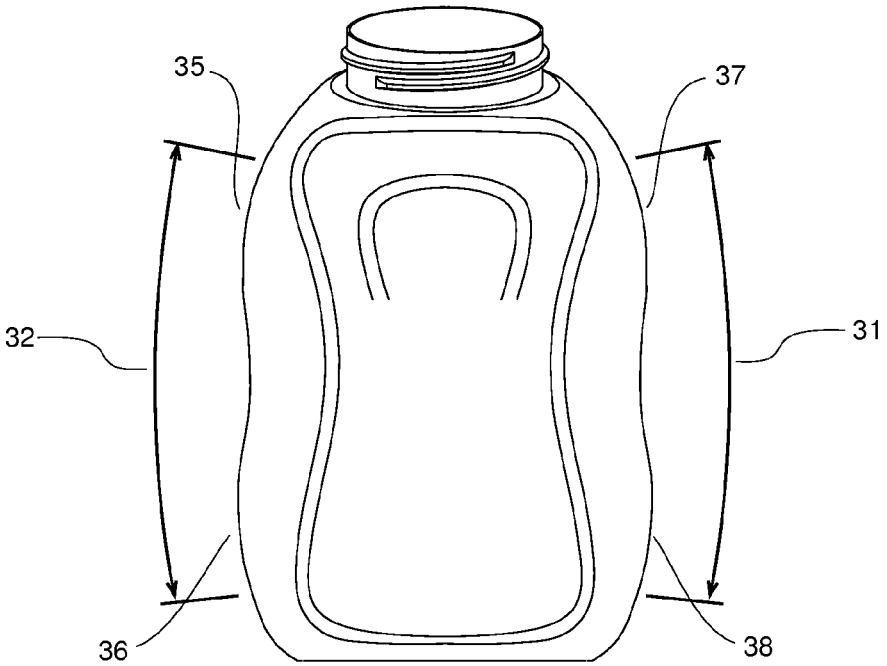
FIG. 10 is a front view of the bottle 20.

FIG. 10 is a front view of the preferred bottle 20. The left and right sides 31 and 32 of the bottle are configured such that when a user applies an inwardly-directed force to the guides 21 and 22 the force deflects the sides 31 and 32 easily and thus the bottle is readily removable from the clip.

In a preferred example, the sides 31 and 32 are molded in a soft rounded shape (that is, a shape having a relatively large and constant radius along the sidewall), also forming a shallow hourglass configuration when viewed from the front or the back, as with FIGS. 9 and 10. The guides 21 and 22 are preferably positioned at the narrow waist of the hourglass, with deflection zones 35, 36, 37, 38 being formed above and below the waist, at the top and bottom of the bottle. This softened geometry allows the bottle to deflect easily in the deflection zone areas in a controlled (and non-buckling way) such that these bottle surfaces in combination with other disclosed bottle surfaces provide the desired result of the bottle being able to be controllably and easily flexed along the sides 31 and 32, allowing the bottle to be easily removable from the clip.

As also seen in FIG. 9, the wells 23, 24, 25, 26 are placed in two pairs, one on the left side and one on the right side of the bottle. Each pair of wells is positioned with one vertically above the other, for example with a first well 23 just above one upright of the flared U-shape forming the left guide 22, and a second well 24 just below the second upright of the flared U-shape forming the left guide 22. The right side of the bottle is formed as a mirror image. The wells are also positioned along a portion of the bottle that is prone to deflection upon application of a force against the guides, as described above.

While the sides of the bottle can be formed in a variety of ways to produce a similar result, it is preferable for the sides of the bottle to be formed with a soft rounded cross-section that does not stiffen in an undesirable way such that would hamper the easy removal of the bottle from the clip.

Figure 12:
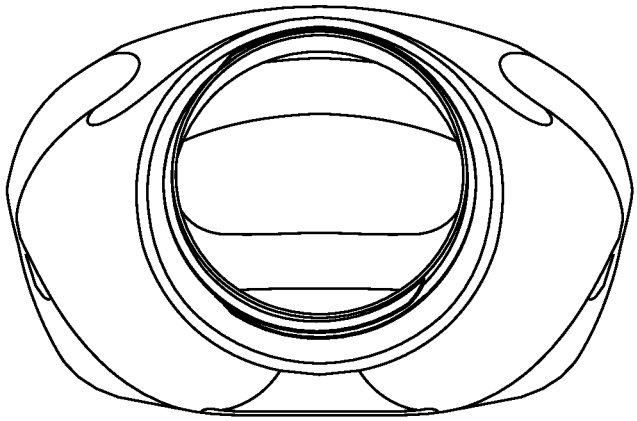
FIG. 12 is a top view of the bottle 20.
Figure 13:
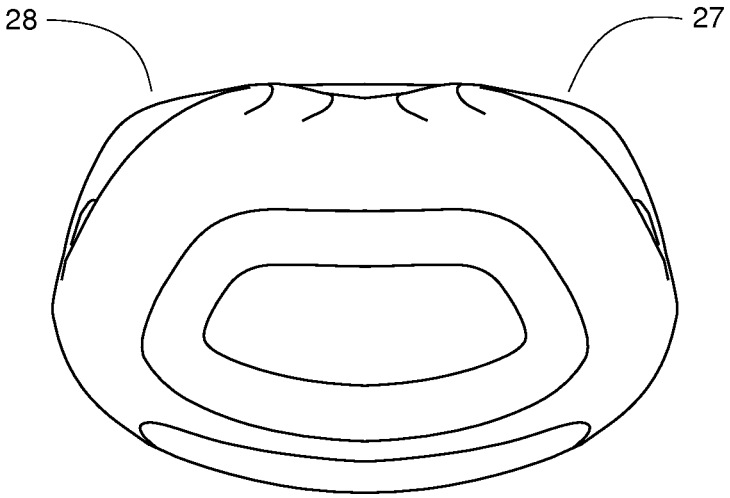
FIG. 13 is a bottom view of the bottle 20.

FIG. 12 is a top view of a preferred bottle 20 and FIG. 13 is a bottom view of the bottle 20.

FIG. 14 is a side view of a bottle and clip as described above, in which the arrow 40 indicates the direction in which the bottle is moved to guide the bottle into the clip. As illustrated, the arms are positioned above and below the guide so that the protrusions on the arms can engage the lead-in surfaces 33*a*, 34*a* to direct the protrusions into the wells. An optional gripping surface 4 is also shown on the guide.

Figure 15:
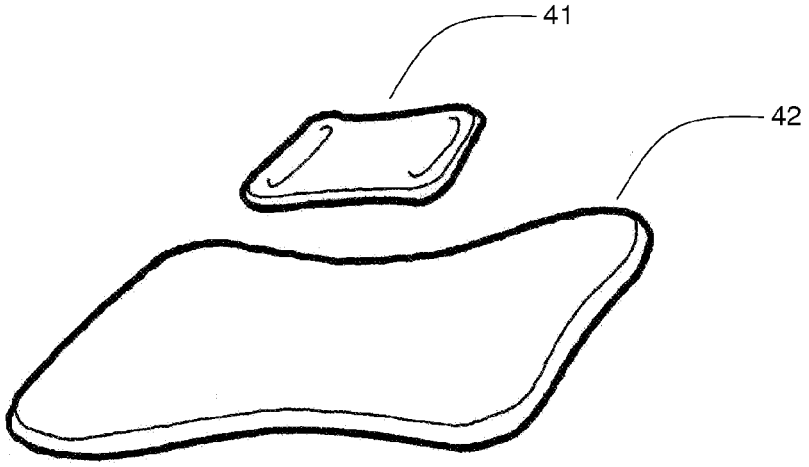
FIG. 15 is an exploded view of a preferred pad assembly.

FIG. 15 is an exploded view of a preferred pad assembly having a pad retainer, 41 which is preferably sewn to a pad 42 preferably with stitching 43 and 44 as shown in the assembled view of FIG. 16. The pad retainer 41 is a preferably substantially flat die-cut or injection molded plastic sized such that it is slightly larger than the through-hole 2 in clip wherein pad 42 can be folded and pressed through hole 2 wherein pad assembly is held trapped in place on the back side of the clip 1. The pad 42 is preferably formed from die-cutting a self-edge-sealing headliner or similar material, or is manufactured using techniques for producing pads or pad-like materials. For example, a thin sheet of polyurethane, polyethylene or similar foam (open or closed-cell or the like) may be laminated to a fabric material (such as coolmax, brushed nylon, spandex, lycra or other materials). In a preferred example, the pad 42 is a single swatch of fabric laminated foam sheet that can be edge-bound (or not) such as using self-sealing foam materials, serger-stitch binding or using other edge binding materials, or may be two sheets of material sewn together and flipped inside out.

Figure 18:
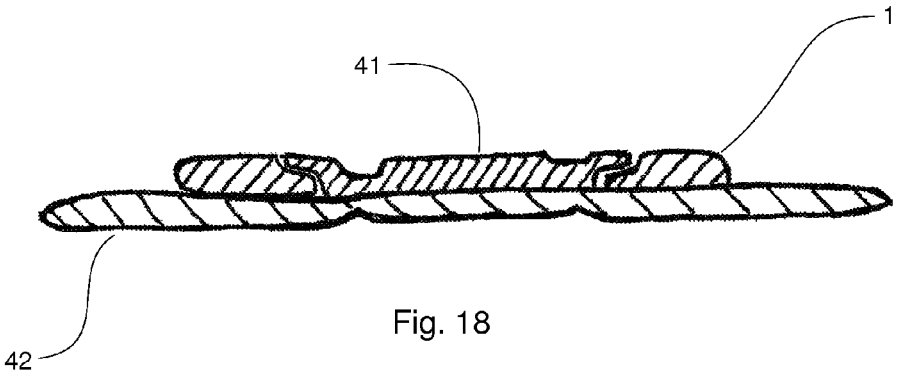
FIG. 18 is a section view along line A-A of FIG. 17.
Figure 19:
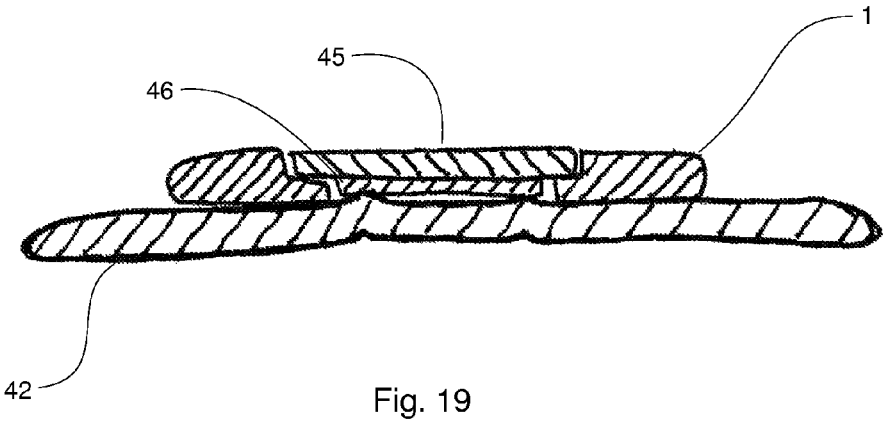
FIG. 19 is a secondary embodiment of a section view cut through section A-A of FIG. 17.

The pad assembly can be fastened to the clip by pressing the retainer part 41 through clip hole 2 such that it is forced through and snaps in place where it is held firmly nested in formed features on clip base (as well as retainer 41 can be turned sideways such that it can be pushed in and retained securely nested/fastened to clip 1 (see FIGS. 18 and 19 for cross-section embodiments through pad and clip). The retainer 41 can be sewn to a variety of substrates such as belts, packs, panels, straps, etc. such that the preferable clip can be mounted directly to the substrate item via retainer 41.

FIG. 16 a perspective view of an assembled pad of the preferred invention and FIG. 17 is a perspective view of a clip in which the preferred pad assembly having a pad 42 and retainer 41 joined by stitching 43, 44 is assembled to the clip such that it is held in place trapped in a through-hole formed in the base of the clip.

FIG. 18 is a section view taken through section A-A of FIG. 17 wherein 41 is an embodiment of a pad retainer that is preferably injection molded such that it fits nested into the clip 1. FIG. 19 is an alternate embodiment of a section view cut through section A-A of FIG. 17 in which the embodiment further includes a retainer 45. The retainer 45 can be a die-cut (or otherwise formed) component fastened to the pad 42 by stitching, glue, ultrasonic boding, direct molding onto the pad 42. An intermediate bonding element 46 such as glue or the like may also be used. Alternatively, the intermediate element may form a spacer or colored element trapped under the retainer 45 wherein the retainer 45 could be molded in a clear or translucent material such that the color or other graphic could show through.

Figure 20:
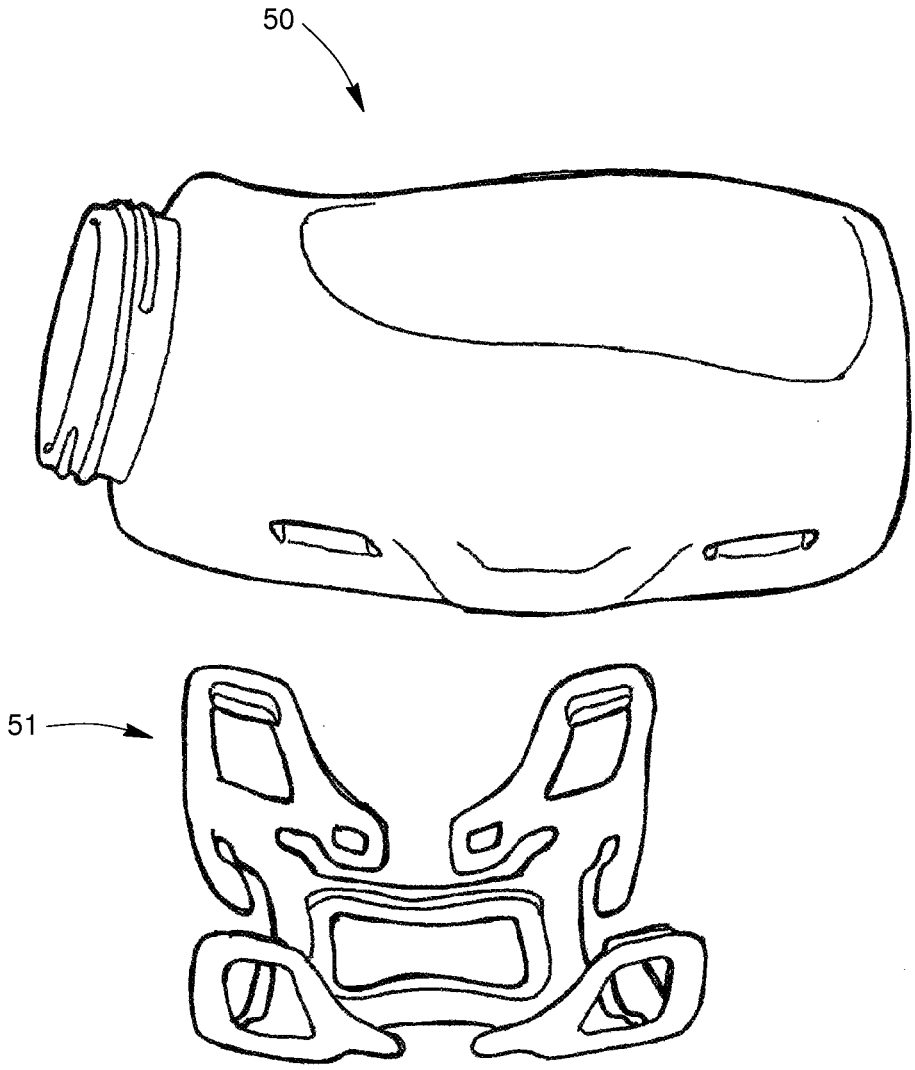
FIG. 20 is a front perspective view of a clip with mating bottle that is representative of a preferred embodiment of the disclosed invention.
Figure 21:
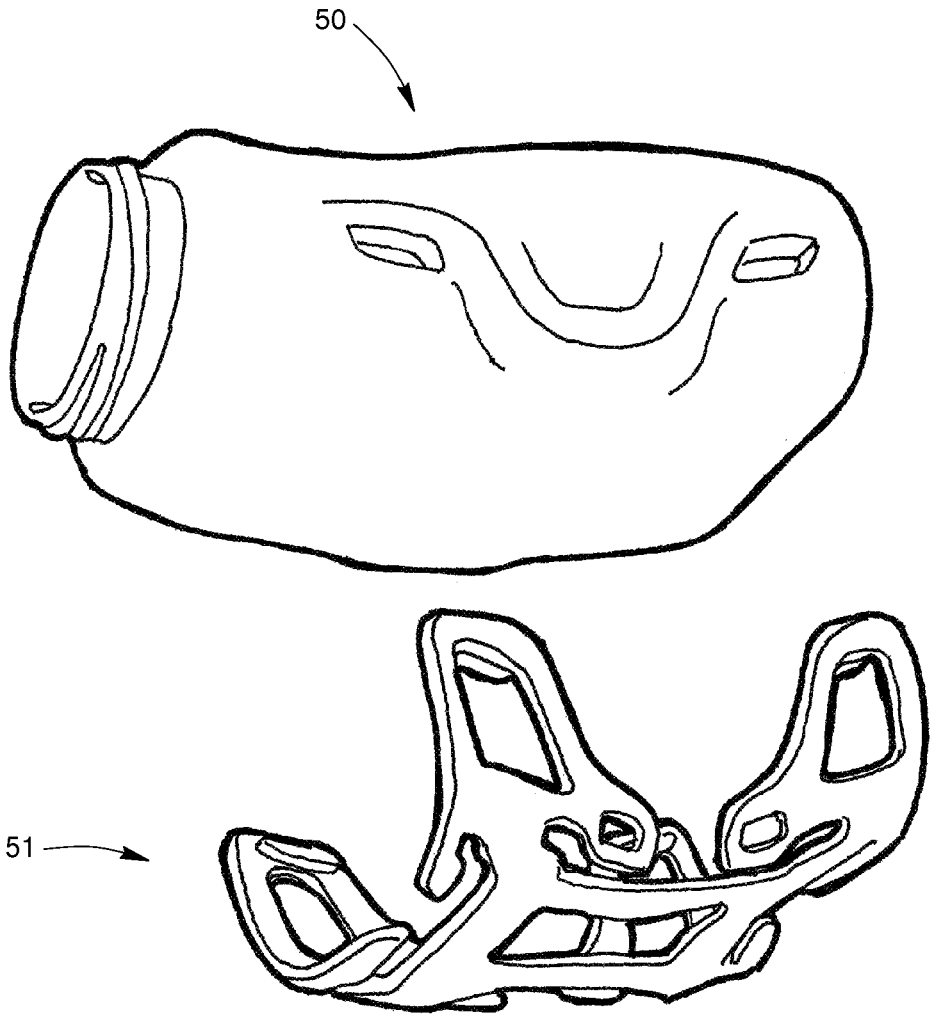
FIG. 21 is a back perspective view of a clip with mating bottle that is representative of a preferred embodiment of the disclosed invention.

FIG. 20 is a front perspective view of a clip 51 with mating bottle 50 that is representative of another embodiment of the disclosed invention wherein in this embodiment the clip arms are formed such that they have through-holes in their sides to reduce weight, for manufacturing/molding reasons and/or other manufacturing, structural, functional or aesthetic reasons which in some cases could be desirable. FIG. 21 is a back perspective view of the clip with mating bottle shown in FIG. 20.

Figure 22:
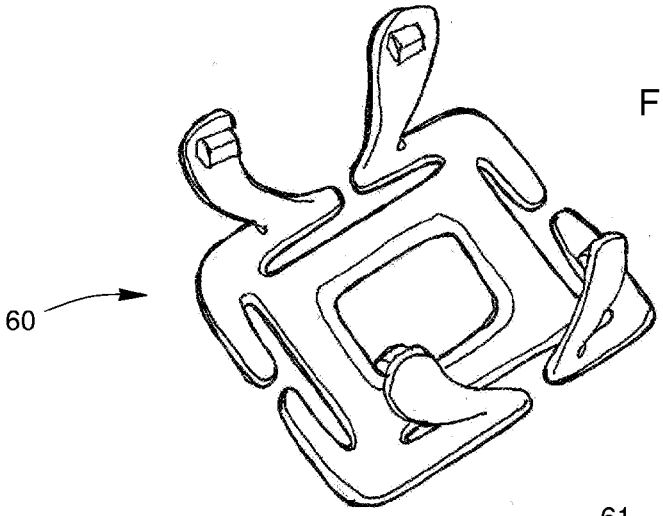
FIG. 22 is a perspective view of an alternate embodiment of the invention.
Figure 23:
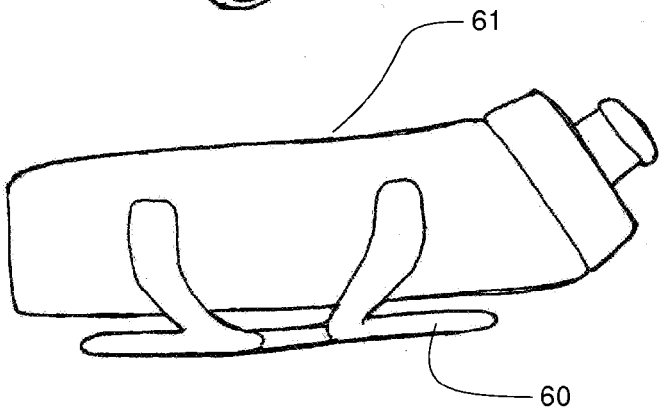
FIG. 23 is a side view of the embodiment shown in FIG. 22 wherein an example bottle 61 is installed in a clip 60.

FIG. 22 is a perspective view of another alternate version of the invention wherein the clip arms extend from a position adjacent the opening of belt slots in base of clip 60. FIG. 23 is a side view of the embodiment shown in FIG. 22 wherein an example bottle 61 is installed in the clip 60, in a similar manner as previously shown embodiments. The guides and lead-in features on the bottle may be provided in the sidewall as disclosed in previously described embodiments, but are not shown in FIG. 23.

Figure 24:
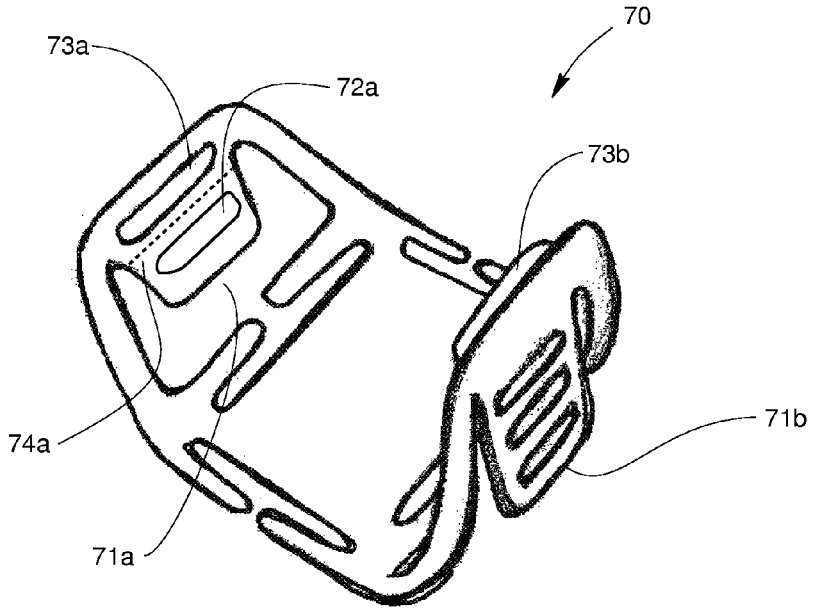
FIG. 24 is a perspective view of an alternate embodiment of the invention.
Figure 25:
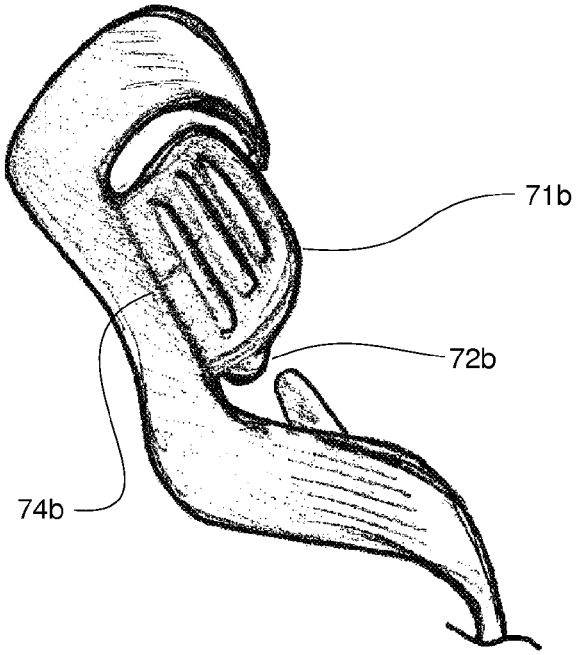
FIG. 25 is a partial cutaway perspective view of a similar embodiment to the one shown in FIG. 24.
Figure 26:
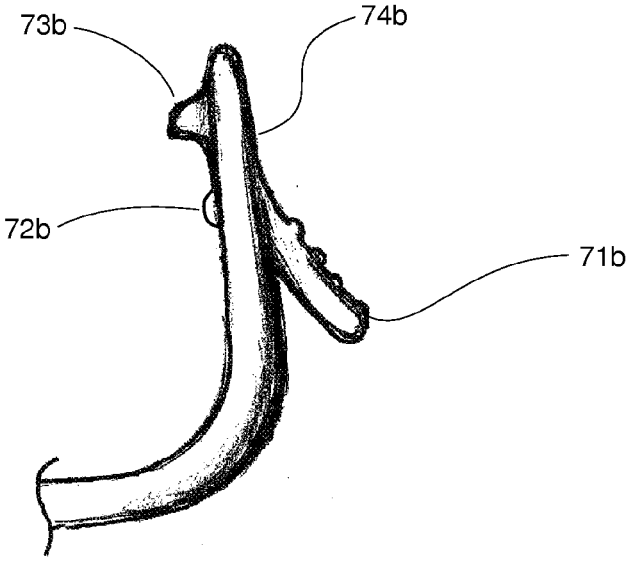
FIG. 26 is a side view of the portion of the embodiment shown in FIG. 26.

FIGS. 24-26 illustrate views of an alternate version of a clip wherein inward-facing projections 72*a* and 72*b* are formed on opposing tabs to press against and eject the bottle when the opposing tabs 71*a* and 71*b* are pressed inward. Upper projections 73*a*, 73*b* engage channels formed in the bottle to secure the clip to the bottle, and are then released and ejected upon a force applied to the tabs which causes pivotal rotation of the tabs and urges the projections 72*a*, 72*b* against the bottle.

FIG. 25 is perspective view of a portion of a variation of the clip shown in FIG. 24, configured such that when a force is applied to tab 71*b* a protrusion 72*b* presses against the bottle sidewalls, deflecting the bottle sidewalls to relieve the bottle from being held trapped in the clip. FIG. 25 illustrates one side of the clip, in which the opposite side is configured as a mirror image.

FIG. 26 is another view of the portion of the embodiment shown in FIG. 24 wherein 71*b* (and/or 71*a*) can be pressed to deflect this feature such that force is applied to 72*a* and 72*b* to press on the bottle out of preferable nesting divots in bottle sidewalls such that retaining features 73*a* and 73*b* are relieved from being held in mating preferably concave features molded into the bottle sidewalls. Optional living hinge or the like features 74*a* and 74*b* preferably allow 71*a* and 71*b* to flex into bottle sidewalls.

Figure 27:
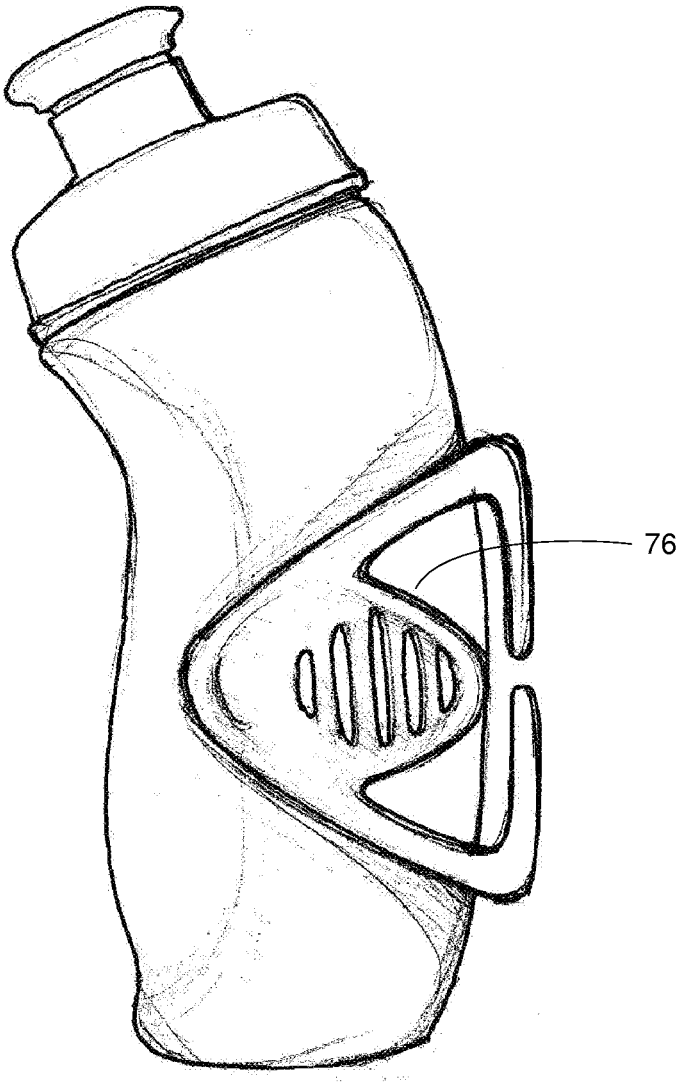
FIG. 27 is a side view of an alternate embodiment that is similar to the one shown in FIG. 24.

FIG. 27 is a side view of an alternate embodiment that is similar to the one shown in FIG. 24. Similar features as disclosed in FIGS. 24 through 26 are incorporated into the clip 76 such that a bottle may be held and ejected from the clip as desired. Instead of a more local living hinge as disclosed in FIGS. 24-26, the clip arms themselves are configured to be flexible so that they may bend and allow this area to flex which would apply pressure on the bottle back side surfaces to eject the bottle.

Figure 28:
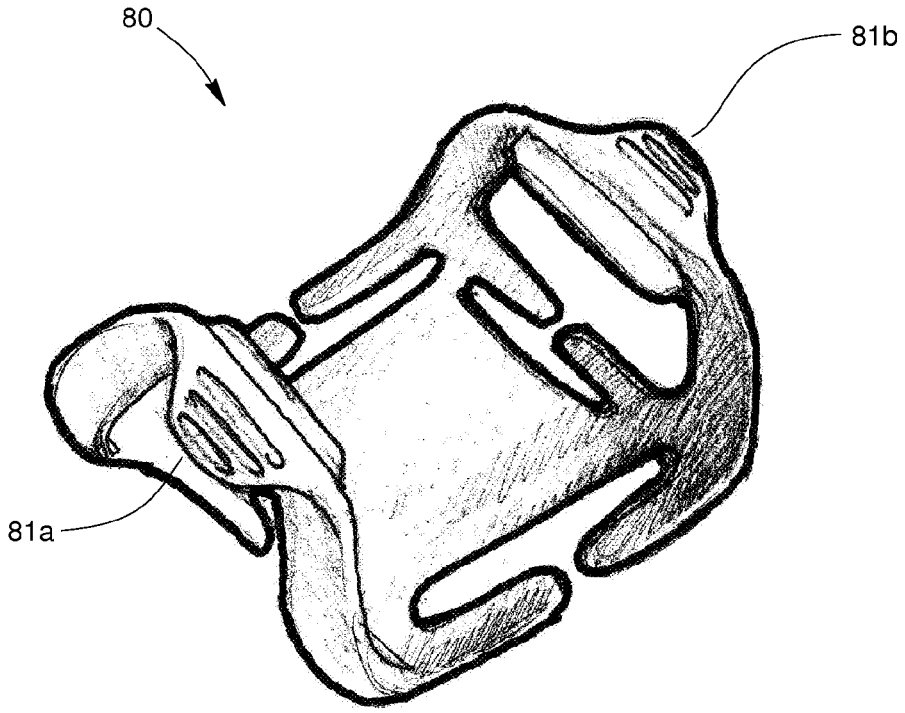
FIG. 28 is a perspective view of an alternate embodiment of a clip according to the invention.

FIG. 28 is a perspective view of another embodiment wherein laterally extending tabs 81*a* and 81*b* would provide ejection surfaces adjacent clip retention projections. The tabs 81*a* and 81*b* may be pressed downwardly and outwardly to deflect the clip to facilitate bottle removal.

Figure 29:
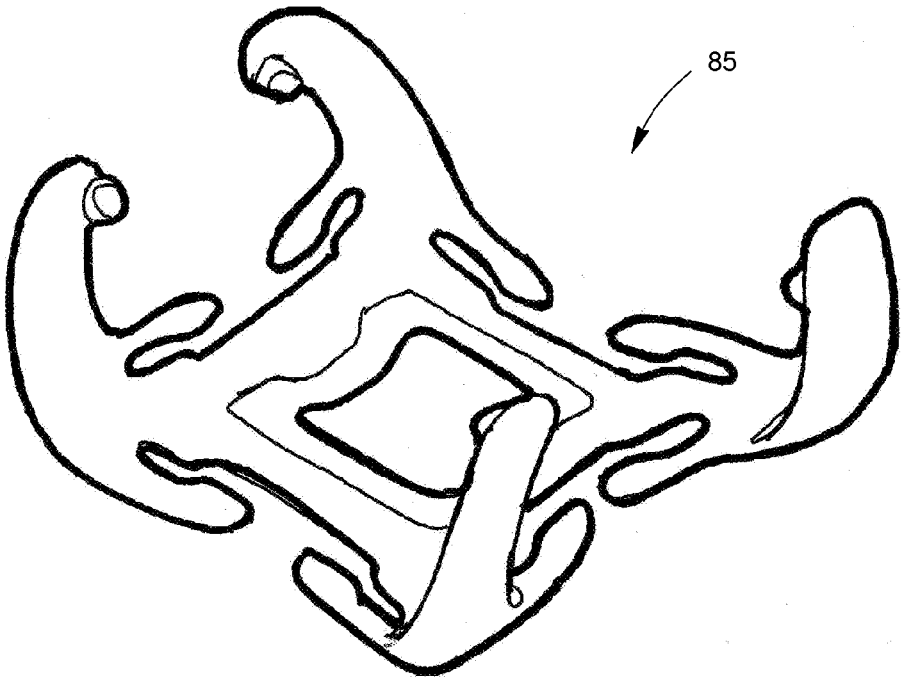
FIG. 29 is a perspective view of an alternate embodiment of the invention.

FIG. 29 is a perspective view of another embodiment of the invention, wherein jogged slots are incorporated to facilitate the use of belts of varying widths within the slots. A belt with a smaller width would be trapped in place in the narrower offset area and a wider belt would rest in the wider slot area.

Figure 30:
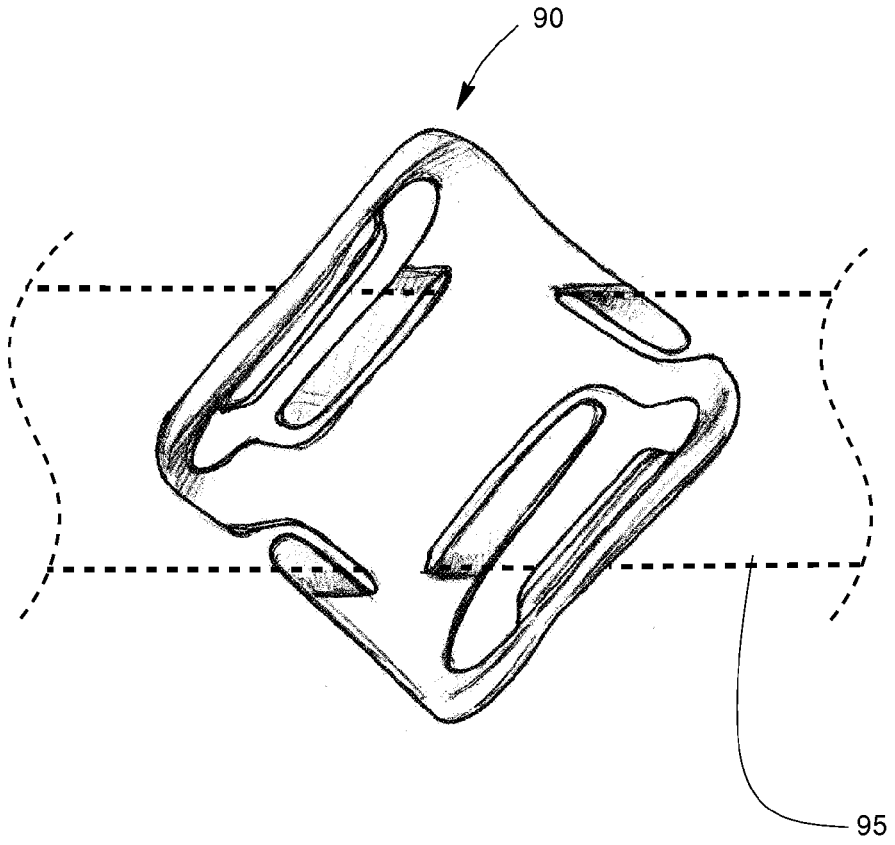
FIG. 30 is a top view of an alternate embodiment.

FIG. 30 is a top view of an optional version of a clip 90 wherein another slot arrangement is disclosed such that a strap can be held at an angle to the clip and bottle. As illustrated, the slots are formed in a complementary manner extending upward and downward on opposing sides, such that the belt such that the belt 95 is received within the opposing slots and the clip 90 is oriented at an angle defined by the depth of the slots.

Figure 31:
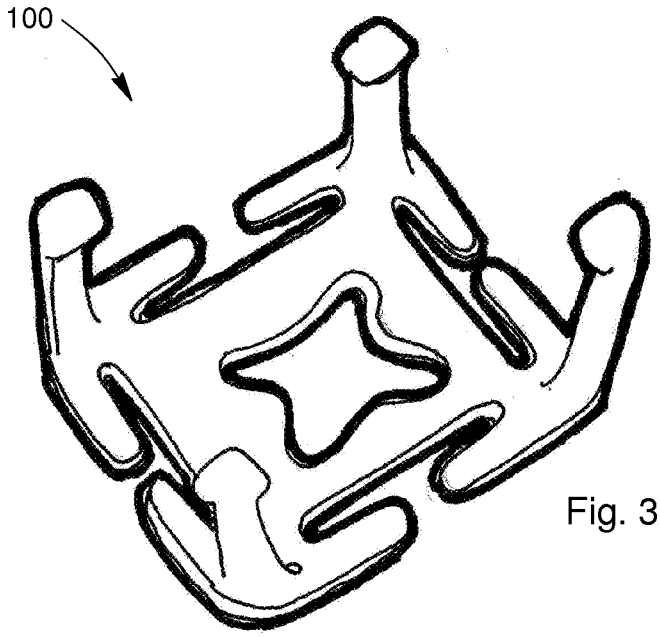
FIG. 31 is a perspective view of an alternate embodiment.
Figure 32:
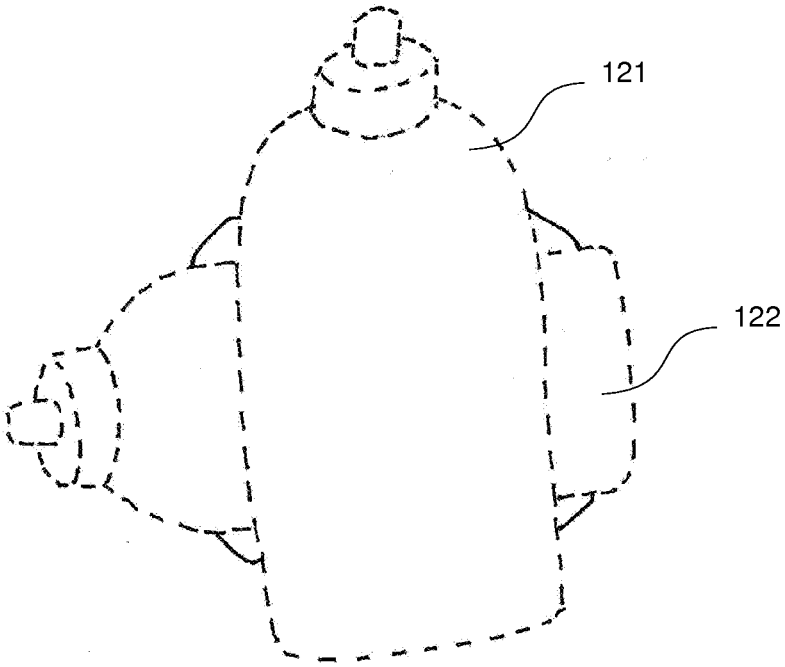
FIG. 32 is a top view of the embodiment shown in FIG. 31 wherein an example bottle is shown in two positions 121 and 122, such that it can be understood that a bottle can be placed in the shown orientations in FIG. 32 wherein the clip will accept the bottle in at least the shown positions. It should also be noted that the bottle position 121 could also be inverted as desired by the user and the bottle position 122 could be flipped such that the spout is facing to the right instead of to the left as position 122 shows in FIG. 32.

FIG. 31 is a perspective view of an alternate version of a clip 100, wherein arms extend from the base to provide a fastening means for a bottle such that the bottle can be attached to clip 100 in at least the positions shown in FIG. 32.

FIG. 32 is a top view of the clip of FIG. 31 wherein an example bottle is shown in two positions 121 and 122, such that it can be understood that a bottle can be placed in either orientation because the clip 100 will accept the bottle in at least the two positions as shown. It should also be noted that the bottle position 121 could also be inverted as desired by the user and the bottle position 122 could be flipped such that the spout is facing to the right instead of to the left as position 122 shows in FIG. 32. The geometry of the clip is sized and formed such that it will accept and fasten the bottle with protrusions on the clip and recesses in the bottle sideways such that the bottle can be placed in the clip in a variety of ways (as shown and disclosed above).

Figure 33:
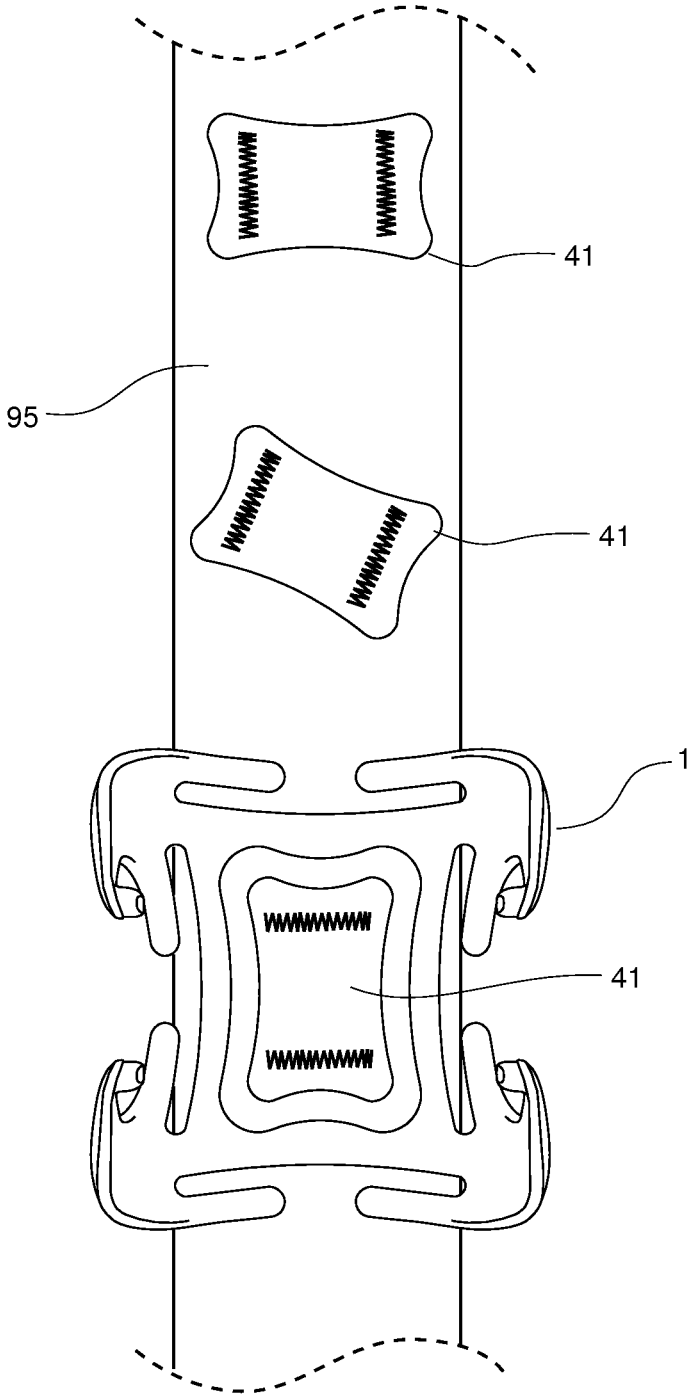
FIG. 33 is a front view of a preferred clip wherein a number of pad retainers 41 are attached to a strap 95 and a clip 1 is fastened to one of the pad retainers.
Figure 41:
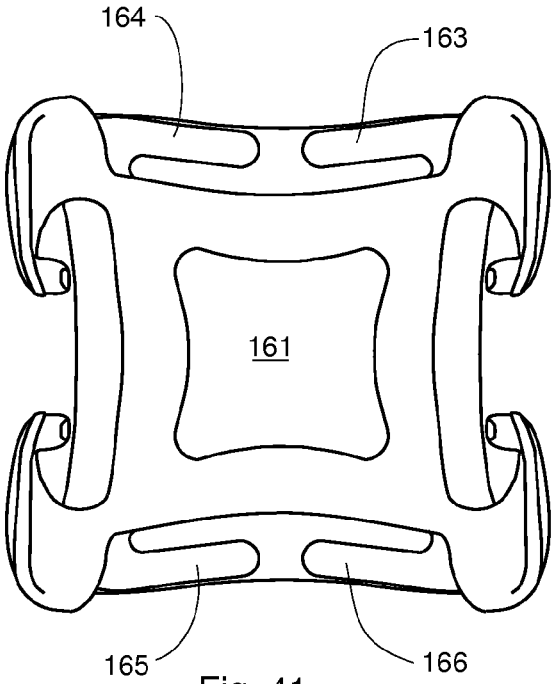
FIG. 41 is a front view of a clip wherein a pad retainer protrusion 161 is snapped through a hole such that the front of the pad retainer faces the back of clip showing another assembly method.
Figure 42:
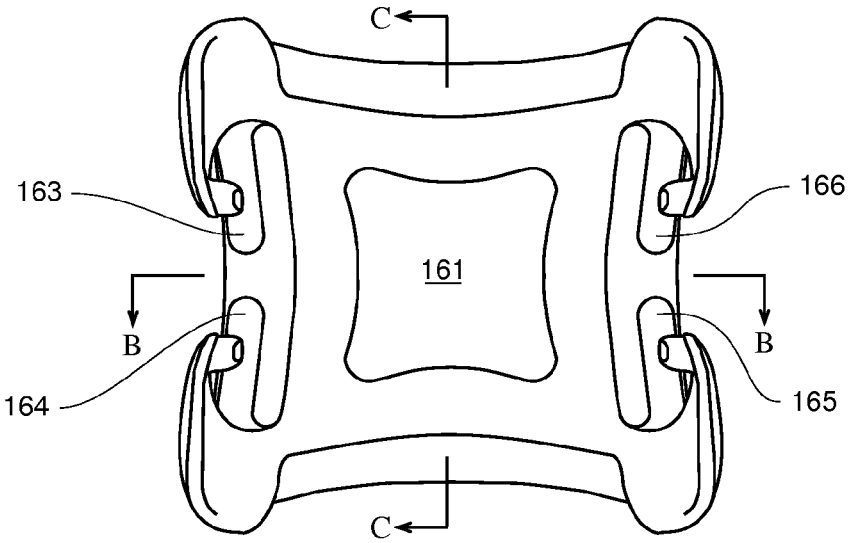
FIG. 42 is the same as FIG. 41 except the pad and pad retainer assembly as shown in FIG. 36 is rotated 90 degrees and then snapped to the clip. Section cutting planes B-B and C-C are shown and referenced in other figures.

FIG. 33 is a front view of a preferred clip and strap, wherein a number of pad retainers 41 are attached to the strap 95 by stitching them in place, and a clip 1 is fastened to one of the pad retainers (such as a pad retainer as shown in FIGS. 15-19 and 33). The retainers can optionally be used to connect a clip to a strap directly without using a pad (and in some such versions the strap becomes the pad). It can be seen the pad retainers 41 can be positioned (sewn or otherwise riveted, integrally molded or otherwise fastened) in a variety of locations and angles such that a clip can be fastened to the desired substrate (in this case strap 95) as desired by a user. It should be noted that a pad retainer and mating through-hole in clip can be configured in a number of shapes such that the clip can fasten at different angles to the substrate. For example the clip retainer through-hole could be square and then the clip could be assembled to the clip retainer in more than one position (zero degrees, 90 degrees, 180 degrees and 270 degrees, for example). As seen in FIGS. 41 and 42, a substantially square hole 141 (shown in FIG. 34) allows the pad retainer and pad to be mounted in a variety of orientations as selected by a user. FIG. 41, for instance, shows a pad retainer 160 in a position such that the slots formed by protrusions 163, 164, 165, 166 are horizontal on the page and in FIG. 42 the pad retainer is shown rotated 90 degrees from the orientation of FIG. 41 as a square shaped pad retainer could be configured as shown to allow this user changeable positioning.

A pad retainer and mating hole in the clip could be made in mating octagonal, hexagon-shaped, gear, or other keyed shapes that allow the pad retainer and clip to fix to each other at different user-configured angles. FIGS. 41 and 42 show a simplified example of this concept wherein a keyed square shape (or gear shape with four cogs) allows a user to place the pad retainer with respect to the clip in four different user configurable positions (two different positions are shown, one in FIG. 41 and another in FIG. 42 such that the slots formed by projections 163, 164, 165, 166 can be placed in the different positions with respect to the clip shown in FIG. 41 and FIG. 42.

Figure 34:
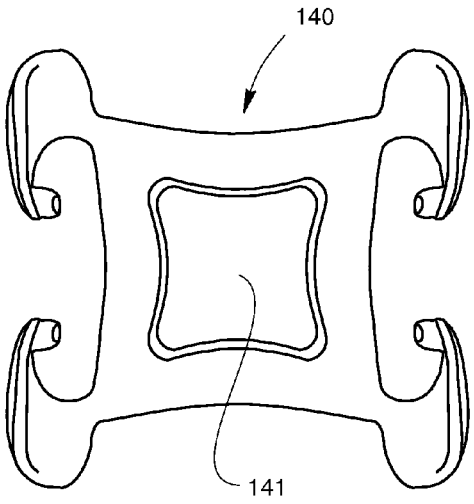
FIG. 34 is a front view of an alternate clip 140 with through-hole 141.
Figure 35:
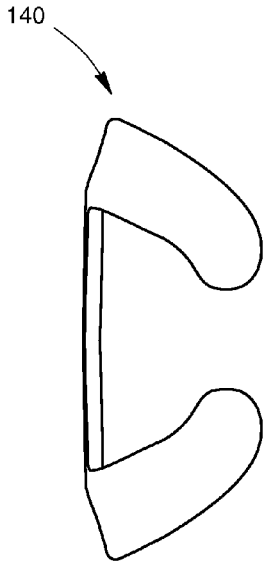
FIG. 35 is a side view of the embodiment shown in FIG. 34.

FIG. 34 is a front view of an alternate clip 140 with through-hole 141, FIG. 35 being a side view thereof. FIG. 34 shows how the slots could be removed from the clip and added to the pad retainer or another part such that the slots can be positioned by snapping protrusion 161 through hole 141 trapping a pad retainer (and pad) in place on the clip 140.

Figure 36:
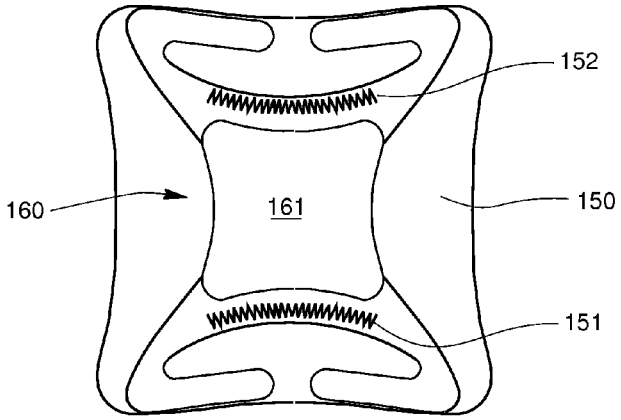
FIG. 36 is front view of an alternate pad retainer 160 having a protrusion 161, with a pad attached to the pad retainer 160 by stitching 151 and 152.

FIG. 36 shows an alternate preferred pad retainer 160 with a pad attached to the retainer 160 by stitching 151, 152 (although stitching is shown other methods of attachment could be used like glue, rivets, integrally molding, etc.). Pad retainer protrusion 161 is also labeled.

Figure 37:
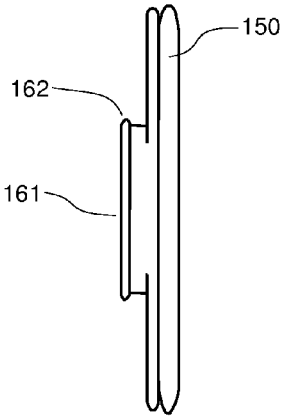
FIG. 37 is a side view of the embodiment shown in FIG. 36.

FIG. 37 is a side view of the embodiment shown in FIG. 36. FIG. 36 shows how a preferably soft pad or the like can be assembled to a clip retainer as disclosed in FIGS. 36 through 39, for example, by stitching wherein slots on the pad retainer can be user configurable to a clip.

Figure 38:
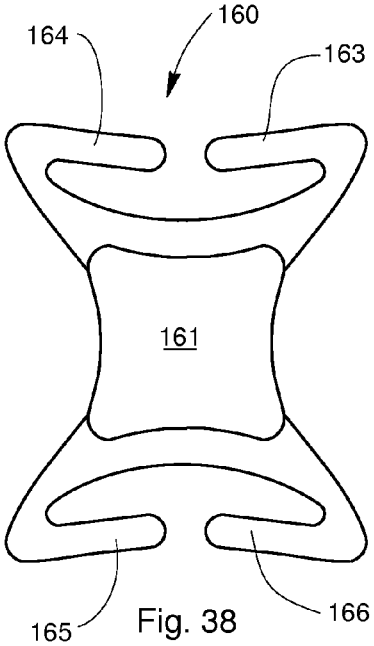
FIG. 38 is a front view of an alternate pad retainer 160.

FIG. 38 is a front view of an alternate pad retainer 160 preferably molded from semi-rigid plastic or the like.

Figure 39:
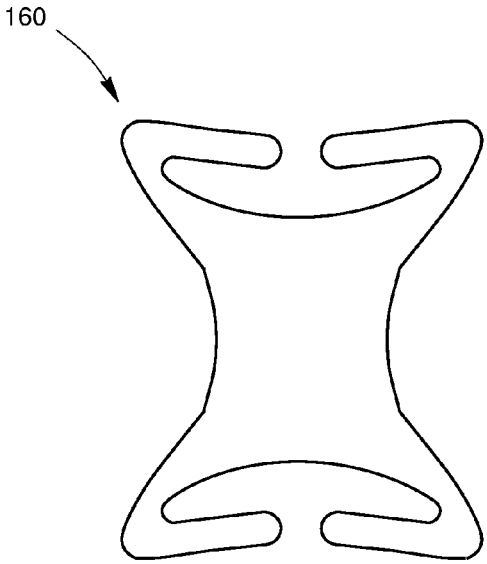
FIG. 39 is a back view of the pad retainer shown in FIG. 38.

FIG. 39 is a back view of the pad retainer shown in FIG. 38.

Figure 40:
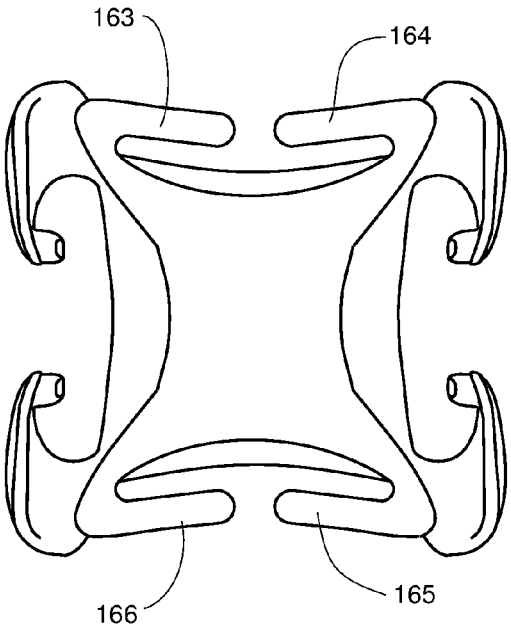
FIG. 40 is a front view of a clip 140 wherein a pad retainer 160 is snapped into a hole 141 with the front side of the retainer 160 facing the front side of the clip 140, showing one method of assembly.

FIG. 40 is a front view of a clip 140 wherein a pad retainer protrusion 161 is snapped into a hole 141 with the front side of pad retainer 160 facing the front side of clip 140 showing one method of assembly of parts 140 and 160 wherein the pad retainer can be snapped in place such that in is sandwiched between the clip and a preferable bottle held in the clip. Pad retainer 160 can be assembled to clip 160 without pad 150 wherein the pad retainer 160 serves to allow a user to configure slots on clip 140 as desired (FIG. 40 shows one method and FIGS. 41 and 42 show other configurations).

FIG. 41 is a front view of a clip 140 wherein a clip retainer 160 and pad 150 assembly as shown in FIG. 36 is assembled to the clip 140, and wherein a pad retainer protrusion 161 is snapped through hole 141 such that the front of pad retainer faces the back of clip 140 showing another assembly method of parts 140, 160 (and 150 which is sewn to 160 by stitching 151 and 152).

Figure 43:
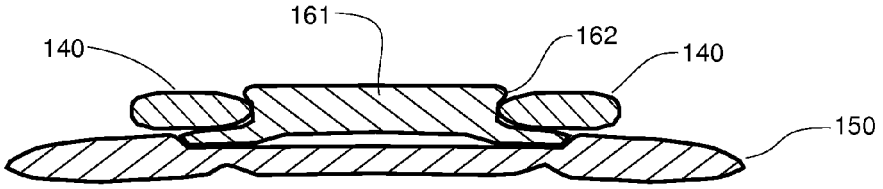
FIG. 43 is a section view taken through line B-B of FIG. 42. Only the cut section area is shown for simplicity of the drawing in FIGS. 43 and 44.
Figure 44:
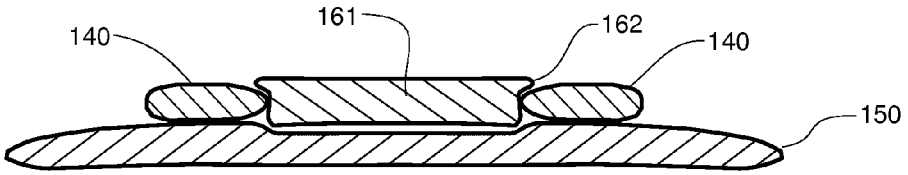
FIG. 44 is a section view taken through line C-C of FIG. 42.

FIG. 42 is the same as FIG. 41 except pad and pad retainer assembly as shown in FIG. 36 is rotated 90 degrees and then snapped to clip 140 (protrusion 161 snapping through hole 141 with lip 162 retaining 160 in place therein, see FIGS. 43 and 44 showing sections through the center areas, sections taken through cutting planes shown in FIG. 42).

In FIGS. 41 and 42, pad 150 would sandwich clip retainer 160 between clip 140 and pad 150 wherein clip and pad retainer would be sandwiched between pad 150 and a preferable bottle retained in the clip.

FIG. 43 is a section view cut through section B-B of FIG. 42. Only the cut section area is shown for simplicity of the drawing in FIGS. 43 and 44. FIG. 44 is a section view cut through section C-C of FIG. 42. FIGS. 43 and 44 show how clip 140 can be attached to pad retainer 160 such that protrusion 161 is pressed/snapped through hole 141 and retained, trapped in place by lip 162, pad 150 being held to pad retainer 160 by stitching 152 and 151 shown in FIG. 36. Lip 162 is configured such that the pad retainer can be snapped in place and removed by a user as desired but this method of using lip 162 could be replaced with a different method of attaching 160 to 140 such as Velcro or other methods of affixing these parts together could be used. Further pad 150 and pad retainer 160 could be combined in one part (using co-molding or the like processes) wherein soft pad-like materials are integrally formed with harder materials preferably to form the slots. It should be noted that although pad retainer 160 is shown with two slots formed by protrusions 163, 164, 165 and 166 it could also be formed with four slots (two more formed and 90 degrees to the first two slots similar to the slot configuration shown in FIG. 22). And, if desired features could be added in the slots to allow different width belts to be placed in the slots whereby the features (a jog in the slot or the like) would center the belting in place. See FIG. 29 and FIGS. 20 and 21 for examples of slots with belt centering features.

The novel disclosed clip geometry can be mounted to a belt, which may have a pack, and likewise can be mounted to many other substrates, straps, belts, strips of material, packs, bags, straps, or other devices, allowing ready-access to a bottle or the like. As discussed above the preferred embodiment preferably fastens to a belt/strap or other mounting substrate in a variety of ways as the preferable base with preferable mounting slots/features allows.

The preferred stitching connection 43, 44 as described above could also be accomplished with rivets, various forms of stitching, integrally or insert molded features, this area can be heat sealed together such that a similar binding result is obtained.

Although the preferred pad shown in FIGS. 16 and 17 is disclosed as easily user-removable, the pad alternatively can be integrally formed with the clip via co-molding rubber of foamed/flocked materials. Likewise, it may be applied with adhesive, sewn directly to the clip, riveted, grommeted or otherwise fastened such that the pad is removable or not, as desired. Further, the pad may be eliminated altogether if desired, such that the clip does not have a pad, and in some versions the belt could be assembled such that it feeds through a portion of the back of the clip so that the belt (or pack or other material) functions as a pad.

The preferred clip is ideally constructed by injection molding plastic or other materials into the desired shaped mold. Alternatively, the clip could be constructed by combining a number of parts together via gluing, integrally forming or otherwise fastening parts together that have been manufactured from a variety of processes and techniques. The invention could be constructed in a variety of different ways other than the preferred disclosed manner. For example, various parts of the could be combined, molded as one, woven together, heat sealed together, snapped together, co-molded with materials of different durometers, ultrasonically bonded together or formed in other ways.

The preferable fastening stitches may be replaced with other types of fasteners, or may be integrally formed, woven in place or produced in a variety of other methods, such as snaps, loop systems, magnets, hook and loop systems, and other fasteners.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A bottle for attachment to a retaining clip, the bottle comprising;

a bottom, sidewalls extending vertically from the bottom and forming an opening at an upper end of the bottle, the sidewalls and bottom defining an interior space for retaining a liquid;

the sidewalls comprising a left sidewall and a diametrically opposite right sidewall;

a left guide formed on the left sidewall at a location intermediate the bottom and the opening, the left guide being configured as a protrusion extending outwardly from the left sidewall, the protrusion including a skirt defining an upper lead-in surface and a lower lead-in surface, the upper and lower lead-in surfaces each being inclined with respect to a portion of the vertically extending sidewalls surrounding the upper and lower lead-in surfaces of the left guide, the left guide further having a narrow first end which flares outwardly toward a second end in a horizontal direction away from the first end;

a first concavity formed on the left sidewall along the upper lead-in surface of the left guide, and a second concavity formed on the left sidewall along the lower lead-in surface of the left guide;

a right guide formed on the right sidewall at a location intermediate the bottom and the opening, the right guide being configured as a protrusion extending outwardly from the right sidewall, the protrusion including a skirt defining an upper lead-in surface and a lower lead-in surface, the upper lead-in surface being inclined with respect to a portion of the vertically extending sidewalls surrounding the upper and lower lead-in surfaces of the right guide, the right guide further having a narrow first end which flares outwardly toward a second end in a horizontal direction away from the first end;

a third concavity formed on the right sidewall along the upper lead-in surface of the right guide, and a fourth concavity formed on the right sidewall along the lower lead-in surface of the right guide;

whereby the left and right guides cooperate to direct the retaining clip toward the first, second, third, and fourth concavities for attachment of the bottle to the retaining clip.

2. The bottle of claim 1, wherein the first concavity and the second concavity are positioned at the second end of the left guide.

3. The bottle of claim 2, wherein the left guide is configured with a substantially vertical outer face forming an angle at the juncture of the outer face and the skirt.

4. The bottle of claim 3, wherein the right guide is configured with a substantially vertical outer face forming an angle at the juncture of the outer face and the skirt.

5. The bottle of claim 2, wherein the clip further comprises a plurality of projections, a separate one of the plurality of projections being received within the first, second, third, and fourth concavities to retain the bottle within the clip.

6. The bottle of claim 5, wherein the bottle is formed from a material that is sufficiently flexible such that a force applied inwardly against the left guide and right guide will cause inward deflection of the sidewalls to release the projections from the first, second, third, and fourth concavities.

7. The bottle of claim 4, further comprising an enhanced grip surface formed on the outer face of the left guide and an enhance grip surface formed on the outer face of the right guide.

8. The bottle of claim 7, wherein the enhanced grip surface formed on each of the left guide and the right guide comprises a plurality of raised ridges.

9. The bottle of claim 1, wherein each of the first, second, third, and fourth concavities are formed as wells in the sidewall of the bottle.

10. A bottle for attachment to a retaining clip, the bottle comprising;

a base and sidewalls extending upwardly from the base and forming an opening at an upper end of the bottle, the sidewalls and base defining an interior space for retaining a liquid;

the sidewalls comprising a left sidewall and a diametrically opposite right sidewall;

a left guide formed on the left sidewall at a location intermediate the base and the opening, the left guide extending laterally outwardly from the left sidewall, the left guide including an upper peripheral guide lead-in surface and a lower peripheral guide lead-in surface, the upper and lower lead-in surfaces each being inclined at an angle with respect to the portion of the left sidewall surrounding the left guide;

a first concavity formed on the left sidewall along one of the upper lead-in surface or the lower lead-in surface of the left guide;

a right guide formed on the right sidewall at a location intermediate the base and the opening, the right guide extending laterally outwardly from the right sidewall, the right guide including an upper peripheral guide lead-in surface and a lower peripheral guide lead-in surface, the upper and lower lead-in surfaces each being inclined at an angle with respect to the portion of the right sidewall surrounding the right guide;

a second concavity formed on the right sidewall along one of the upper lead-in surface or the lower lead-in surface of the right guide;

whereby the left and right guides cooperate to direct the retaining clip toward the first and second concavities for attachment of the bottle to the retaining clip.

11. The bottle of claim 10, further comprising:

a third concavity formed on the left sidewall, the first concavity being formed along the upper lead-in surface and the third concavity being formed along the lower lead-in surface of the left guide; and a fourth concavity formed on the right sidewall, the second concavity being formed along the upper lead-in surface and the fourth concavity being formed along the lower lead-in surface of the right guide.

12. The bottle of claim 11, wherein the clip further comprises a plurality of projections, a separate one of the plurality of projections being received within the first, second, third, and fourth concavities to retain the bottle within the clip.

13. The bottle of claim 12, wherein the clip further comprises a base and a first arm having the first projection, a second arm having the second projection, a third arm having the third projection, and a fourth arm having the fourth projection, the clip further defining a first opening between the first arm and the third arm and a second opening between the second arm and the fourth arm, each of the first opening and the second opening being sized and configured to accommodate insertion of a finger to apply force against a respective one of the left guide and the right guide when the bottle is attached to the clip.

14. The bottle of claim 11, wherein the left guide and the right guide are each formed in a flared U-shape having an outer face with a narrow vertically extending first end which flares to a wider vertically extending second end.

15. The bottle of claim 11, wherein the bottle is formed from a material that is sufficiently flexible such that a force applied inwardly against the left guide and right guide will cause inward deflection of the sidewalls to release the projections from the first, second, third, and fourth concavities.

16. The bottle of claim 11, further comprising an enhanced grip surface formed on the guide.

17. The bottle of claim 16, wherein the enhanced grip surface comprises a plurality of raised ridges.

18. A bottle for attachment to a retaining clip, the bottle comprising;

a base, sidewalls extending upwardly from the base to define an interior space for retaining a liquid, the sidewalls comprising a left sidewall and a diametrically opposite right sidewall;

the sidewalls further comprising a plurality of clip mounts arranged for attaching the bottle to the retaining clip;

a left guide formed on the left sidewall, the left guide extending laterally outwardly from the left sidewall, the left guide including a first means for directing the retaining clip toward a first one of the plurality of clip mounts, the first means for directing having a narrow first end and a flared second end, at least a first one of the clip mounts being positioned at the flared second end;

a right guide formed on the right sidewall, the right guide extending laterally outwardly from the right sidewall, the right guide including a second means for directing the retaining clip toward a second one of the plurality of clip mounts, the second means for directing having a narrow first end and a flared second end, at least a second one of the clip mounts being positioned at the flared second end.

19. The bottle of claim 18, wherein the clip further comprises a plurality of inwardly-directed protrusions formed on the clip.

20. The bottle of claim 19, wherein the plurality of clip mounts comprises a plurality of cavities.

21. The bottle of claim 18, wherein the first means for directing comprises a first peripheral surface formed on the guide, the first peripheral surface extending laterally away from the left sidewall.

22. The bottle of claim 21, wherein the second means for directing comprises a second peripheral surface formed on the guide, the second peripheral surface extending laterally away from the right sidewall.

* * * * *